US010612200B2

(12) United States Patent
Bock, II et al.

(10) Patent No.: US 10,612,200 B2
(45) Date of Patent: Apr. 7, 2020

(54) GROUND-BASED VEHICLE BARRIER SYSTEM

(71) Applicant: BARRIER ACTION RESTRAINT SYSTEMS, INC., New Braunfels, TX (US)

(72) Inventors: Bennie W. Bock, II, New Braunfels, TX (US); Jon R. Lockhart, New Braunfels, TX (US); Louis Lutich, Houston, TX (US)

(73) Assignee: BARRIER ACTION RESTRAINT SYSTEMS, INC., New Braunfels, TX (US)

( * ) Notice: Subject to any disclaimer, the term of this patent is extended or adjusted under 35 U.S.C. 154(b) by 0 days.

(21) Appl. No.: 16/223,215

(22) Filed: Dec. 18, 2018

(65) Prior Publication Data

US 2019/0257045 A1 Aug. 22, 2019

Related U.S. Application Data

(60) Provisional application No. 62/632,739, filed on Feb. 20, 2018.

(51) Int. Cl.
*E01F 13/04* (2006.01)
*E01F 13/12* (2006.01)

(52) U.S. Cl.
CPC ..... *E01F 13/044* (2013.01); *E01F 13/04* (2013.01); *E01F 13/12* (2013.01)

(58) Field of Classification Search
CPC ..... E01F 13/044; E01F 13/12; E01F 13/00; E01F 13/123; E01F 13/08; E01F 13/126; E01F 13/10
See application file for complete search history.

(56) References Cited

U.S. PATENT DOCUMENTS

| | | | | |
|---|---|---|---|---|
| 4,879,554 A | | 11/1989 | Diaz-Silveira | |
| 5,322,385 A | | 6/1994 | Reisman | |
| 5,416,941 A | * | 5/1995 | Hageman | B65G 69/2841 14/71.7 |
| 5,704,730 A | * | 1/1998 | Burton-Chambers | E01F 13/123 404/6 |

(Continued)

FOREIGN PATENT DOCUMENTS

| | | |
|---|---|---|
| FR | 16011 | 11/1912 |
| FR | 2627200 | 8/1989 |

OTHER PUBLICATIONS

International Search Report and Written Opinion dated May 1, 2019, issued in PCT/US19/18598 (15 pages).

*Primary Examiner* — Abigail A Risic
(74) *Attorney, Agent, or Firm* — Nixon & Vanderhye PC

(57) ABSTRACT

Ground-based barrier systems for permitting or inhibiting vehicle passage, and capturing unauthorized vehicles. One example of the present technology is directed to a ground-based vehicle barrier system, comprising a bollard movable between a recessed position permitting vehicle passage and an extended position inhibiting vehicle passage. A link is connected to or formed as part of the bollard. The link is extending transverse to the bollard. The ground-based vehicle barrier system further comprises a drive connected to a connection point of the link and configured to selectively move the bollard in the recessed and extended positions.

26 Claims, 17 Drawing Sheets

(56) References Cited

U.S. PATENT DOCUMENTS 6,205,606 B1 * 3/2001 Zibella ..... B65G 69/2835 14/69.5
6,634,049 B2 10/2003 Hahn et al.
6,702,512 B1 * 3/2004 Reale ..... E01F 13/123 404/6
7,216,391 B2 5/2007 Muhl et al.
7,226,238 B2 6/2007 Collier
7,258,461 B1 8/2007 Izardel
7,320,557 B1 1/2008 Potter
8,439,594 B1 * 5/2013 Clark ..... E01F 13/12 256/13.1
8,730,063 B1 5/2014 Souther
9,028,166 B2 * 5/2015 Morgan ..... E01F 13/12 404/6
9,771,696 B2 * 9/2017 Neusch ..... E01F 13/123
2004/0033106 A1 * 2/2004 Turpin ..... E01F 13/08 404/6
2005/0147466 A1 7/2005 Crowley, Sr.
2005/0214072 A1 9/2005 Turpin et al.
2006/0078378 A1 * 4/2006 Burns ..... E01F 13/046 404/6
2006/0233609 A1 * 10/2006 Gelfand ..... E01F 13/08 404/6
2007/0068079 A1 * 3/2007 Morgan ..... E01F 13/06 49/49
2007/0223995 A1 9/2007 Nasatka
2010/0003078 A1 1/2010 Huang et al.
2010/0196093 A1 * 8/2010 Seeglitz ..... E01F 13/123 404/6
2012/0044046 A1 2/2012 Al-Jafar
2012/0134745 A1 5/2012 Blair
2013/0045047 A1 * 2/2013 Morgan ..... E01F 13/08 404/6
2014/0234024 A1 * 8/2014 Brackin ..... E01F 13/08 404/6
2016/0115661 A1 * 4/2016 Neusch ..... E01F 13/123 404/6
2018/0023263 A1 * 1/2018 Rothschild ..... E01F 13/12 404/6

* cited by examiner

GROUND-BASED VEHICLE BARRIER SYSTEM

CROSS REFERENCE TO RELATED APPLICATIONS

This application is a non-provisional of U.S. Application No. 62/632,739, filed Feb. 20, 2018, the entire contents of which are incorporated herein by reference.

FIELD OF THE DISCLOSURE

Certain example embodiments disclosed herein relate generally to a vehicle barrier system, and more particularly, certain example embodiments disclosed herein to systems and techniques for ground-based vehicle barrier systems configured to permit or inhibit vehicle passage, and capture vehicles seeking passage without authorization.

SUMMARY

There are various kinds of vehicle barriers that are often used in providing controlled access of vehicle traffic to restricted areas, such as government buildings, banks, shopping centers, and dangerous areas like roads under construction, or controlling the flow of traffic on roads and highways. Exemplary types of vehicle barriers include plastic barrels, cones, poles, barricades, concrete barriers, and barriers including a gate arm that is operatively pivoted in a horizontal and a vertical position to provide passage of vehicle traffic and the like.

These vehicle barriers have various disadvantages and problems which increase the cost of use and/or the risk of property damage. Vehicle barriers like plastic barrels or cones can easily be blown away by wind storms or by large vehicles colliding with the barrier. Although sandbags may be used to anchor these barrels or cones to the ground, the sandbags might be broken after several uses and spread across the ground, which may increase the risk of car accidents. Vehicle barriers like concrete barriers may not have these issues and may be effective at preventing traffic. However, the concrete barriers are extremely heavy, and hence require substantial amount of time and machinery to be properly shipped and installed. Moreover, the concrete barriers cannot easily switch between a closed position and an open position once these barriers are positioned. Barriers like gates with movable arms are able to switch between a horizontal and vertical positions to control and regulate traffic on roads. However, these gates sometimes may prematurely lower onto an intervening authorized vehicle and cause considerable damages to the vehicle and/or their arms.

One aspect of the present technology is to overcome one or more of the above-noted problems of the known art.

According to one aspect of the present technology, there is provided a ground-based vehicle barrier system including a drive adapted to automatically and/or manually pivot a bollard between a recessed position and an extended position to conveniently and effectively control the passage of vehicles in restricted areas, such as government buildings or parking garages, etc. The ground-based vehicle barrier system can be conveniently folded into a box container for shipment and storage, and can be quickly and easily built into the ground. It also can improve the performance and reliability during use of the ground-based vehicle barrier system.

One example of the present technology is directed to a ground-based vehicle barrier system, comprising a bollard pivotably movable about a pivot axis between a recessed position permitting vehicle passage and an extended position inhibiting vehicle passage. A link is connected to or formed as part of the bollard. The link is extending transverse to the bollard. The link has a connection point, which is substantially vertically aligned with the pivot axis when the bollard is in the recessed position. The ground-based vehicle barrier system further comprises a drive connected to the connection point and configured to selectively move the bollard in the recessed and extended positions.

It is envisioned that the bollard in one example further comprises a sleeve having a distal end and a proximal end and an elbow piece connecting the proximal end of the sleeve with the link of the bollard. The sleeve is reduced in thickness at the distal end. In another example, at least a portion of the link is thinner than the major portion of the elbow piece.

In yet another example, the ground-based vehicle barrier system further comprises a backup member beside the elbow piece of the bollard and configured to restrict rearward movement of the bollard, e.g., during movement of the bollard and/or when the bollard is stopping a vehicle.

In certain examples, the ground-based vehicle barrier system further comprises a LED light located at the distal end of the sleeve. The LED light is configured to emit light when the bollard is in the extended position.

In some examples, the ground-based vehicle barrier system further comprises a camera located at the distal end of the sleeve to record images and/or videos. In these examples, a series of LED lights or a LED ring light may be installed surrounding the camera.

In an example, the ground-based vehicle barrier system further comprises a liquid level switch installed on the sleeve. The liquid level switch is configured to control the operation of a camera and/or a LED light.

In an example, the ground-based vehicle barrier system further comprises a distance sensor switch. The distance sensor switch is configured to control the operation of a camera and/or a LED light.

In one example, the ground-based vehicle barrier system further comprises a housing including a front end and a back end and two sides, forming an elongated space to accommodate the bollard while the bollard is in the recessed position. The housing may further comprise a top lid covering at least a portion of the housing.

In another example, the ground-based vehicle barrier system further comprises at least one anchor member connected to the front end and/or the back end of the housing. The at least one anchor member is configured to fix the housing into the ground.

In yet another example, the ground-based vehicle barrier system further comprises a pivot shaft supported by the two sides of the housing. The bollard is configured to rotate about the pivot shaft between the recessed and extended positions. In some examples, the bollard further comprises a sleeve having a distal end and a proximal end and an elbow piece connecting the proximal end of the sleeve with the link of the bollard, and the elbow piece includes a groove surrounding the pivot shaft.

In one example, the ground-based vehicle barrier system further comprises a controller coupled to the drive. The controller is configured to control the drive to pivot the bollard between the recessed and extended positions in response to a control signal.

In another example, the ground-based vehicle barrier system further comprises a remote controller to initiate the control signal. Alternatively, the ground-based vehicle barrier system further comprises a camera, a proximity sensor, a weight measuring sensor and/or an acceleration sensor to initiate the control signal.

In yet another example, the ground-based vehicle barrier system further comprises a guide around the link to restrict lateral movement of the link. For example, the guide is rectangular in cross-section and is open at one side.

In one example, the drive of the ground-based vehicle barrier system is a hydraulic cylinder.

Some examples are directed to a ground-based vehicle barrier system, comprising a plurality of bollards disposed substantially parallel to each other. Each of the bollards is pivotably movable about a pivot axis between a recessed position permitting vehicle passage and an extended position inhibiting vehicle passage. A link is connected to or formed as part of the bollard. The link is extending transverse to the bollard. The link has a connection point, which is substantially vertically aligned with the pivot axis when the bollard is in the recessed position. The bollard further comprises a drive connected to the connection point and configured to selectively move at least one of the bollard in the recessed and extended positions.

In other examples, each of the bollards further comprises a sleeve having a distal end and a proximal end, and an elbow piece connecting the proximal end of the sleeve with the link of the bollard. The sleeve is reduced in thickness at the distal end.

In another example, the ground-based vehicle barrier system further comprises a housing including a front end and a back end and two sides forming an elongated space to accommodate at least one of the bollards while the bollard is in the recessed position.

Some examples are directed to a ground-based vehicle barrier system, comprising a panel, a bollard fixedly coupled to the panel. The panel and the bollard are pivotably movable together about a pivot axis between a recessed position permitting vehicle passage and an extended position inhibiting vehicle passage. A link is connected to or formed as part of the bollard. The link is extending transverse to the bollard. The link has a connection point, which is substantially vertically aligned with the pivot axis when the bollard is in the recessed position. The bollard further comprises a drive connected to the connection point and configured to selectively move the bollard in the recessed and extended positions.

In one example, the bollard further comprises a sleeve having a distal end and a proximal end, and an elbow piece connecting the proximal end of the sleeve with the link of the bollard. The sleeve is reduced in thickness at the distal end.

The exemplary aspects, and advantages disclosed herein may be provided in any suitable combination or sub-combination to achieve yet further exemplary embodiments.

Some examples are directed to a ground-based vehicle barrier system comprising a bollard movable between a recessed position permitting vehicle passage and an extended position inhibiting vehicle passage, and a backup member positioned at a proximate end of the bollard and configured to restrict rearward movement of the bollard when the bollard is in the extended position.

In one example, the ground-based vehicle barrier system further comprises a link connected to or formed as part of the bollard, the link extending transverse to the bollard, the link being connected to a drive configured to selectively move the bollard in the recessed and extended positions.

In another example, the ground-based vehicle barrier system disclosed above further comprises a guide around the link to restrict lateral movement and upward amount of slope of the link, the guide being rectangular in cross-section and being open at one side.

In yet another example, the ground-based vehicle barrier system further comprises another bollard being movable between a recessed position permitting vehicle passage and an extended position inhibiting vehicle passage, and a chain connecting distal ends of the bollard and the other bollard, ends of the chain each connecting to one of the bollards via a spring.

In some examples, the ground-based vehicle barrier system further comprises a housing including a front end and a back end and two sides forming an elongated space to accommodate the bollard while the bollard is in the recessed position, and a pivot shaft supported by the two sides of the housing, wherein the bollard is configured to rotate about the pivot shaft between the recessed and extended positions.

BRIEF DESCRIPTION OF THE DRAWINGS

The accompanying drawings facilitate an understanding of the various examples of the present technology. In such drawings.

DETAILED DESCRIPTION

In accordance with certain examples, certain systems and devices are disclosed for controlling the passage of vehicles in restricted areas, more particularly, certain examples relate to a ground-based vehicle barrier system including a drive adapted to pivot a bollard between a recessed position and an extended position are described herein. In the following description, for purpose of explanation, numerous specific details are set forth to provide a thorough understanding of the examples. It will be evident, however, to a person skilled in the art that the examples may be practiced without these specific details.

FIGS. 1-4 show non-limiting exemplary scenarios for example ground-based vehicle barrier systems controlling passage of vehicles to a gateway.

Figure 1:
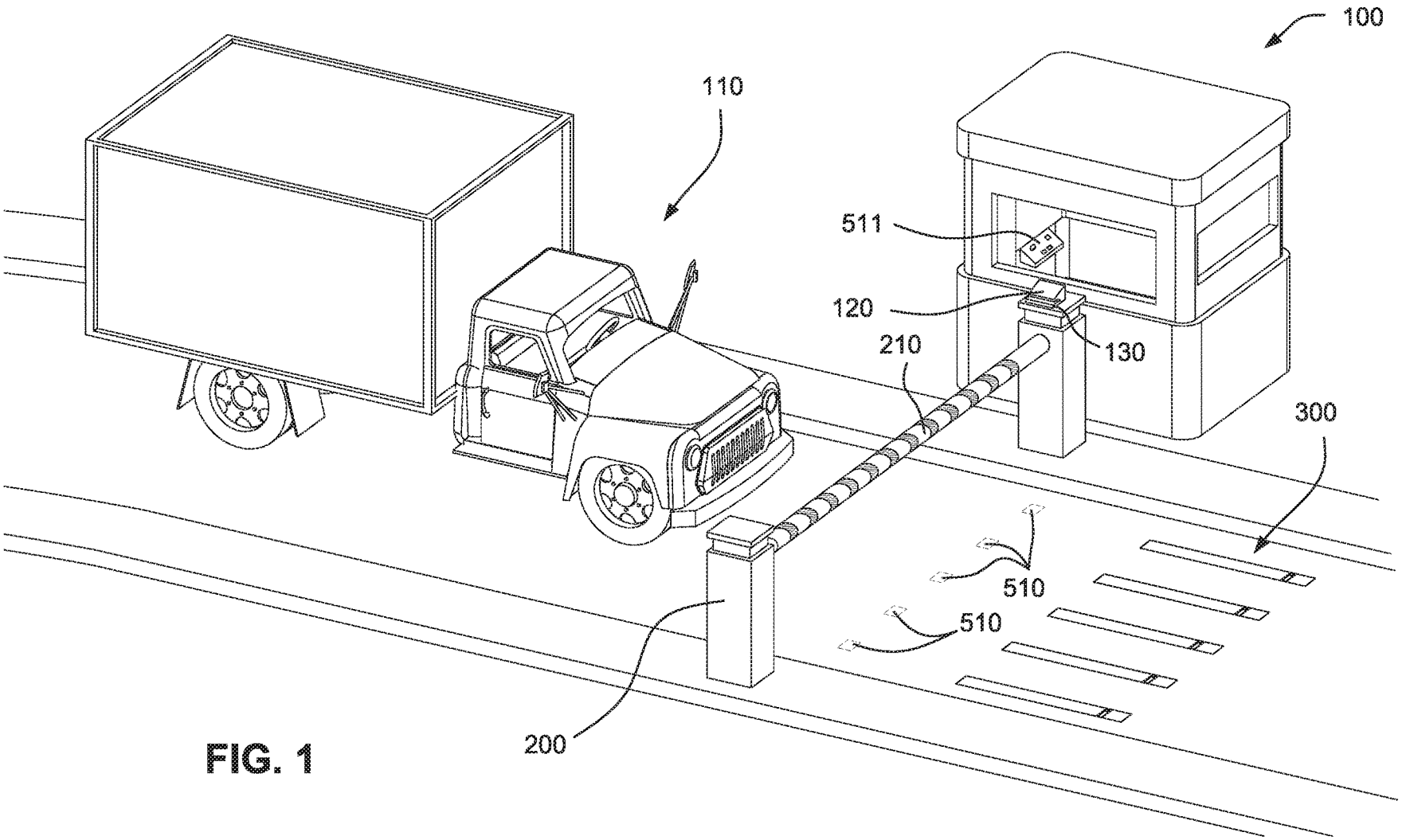
FIG. 1 shows a non-limiting, exemplary scenario for an exemplary security system including an example ground-based vehicle barrier system.
Figure 2:
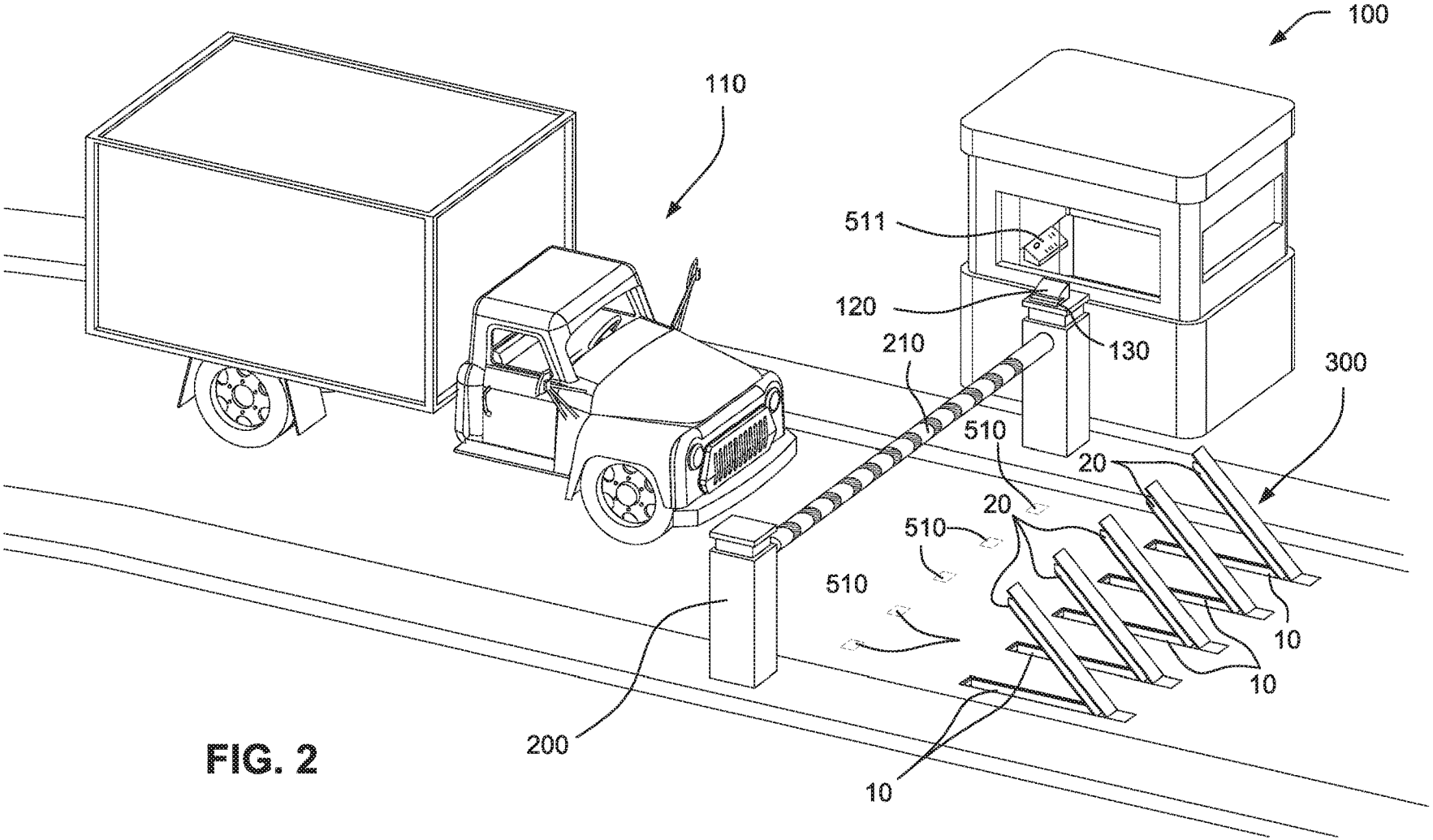
FIG. 2 shows a non-limiting, exemplary scenario for the example ground-based vehicle barrier system shown in FIG. 1.

As shown in FIGS. 1-2, a security system 100 includes a gate control system 200 and an example ground-based vehicle barrier system 300. The gate control system 200 is positioned to control access to an initial portion of the gateway, while the ground-based vehicle barrier system 300 is positioned subsequent to (or before) the gate control system 200 to control access to the gateway. In FIGS. 1-2, for example, a vehicle 110 must pass the gate control system 200 before passing the ground-based vehicle barrier system 300. Alternatively, the security system 100 may only include the ground-based vehicle barrier system 300, without the gate control system 200. In this alternate example, the ground-based vehicle barrier system 300 alone is used as a traffic deterrent, as well as a hard stop barrier in road lanes.

The gate control system 200 may include any type of doors, gates, and other systems for controlling vehicle passage. In the examples shown in FIGS. 1-4, the gate control system 200 includes a vertically rotating arm 210 that lowers (closes) to block access to the gateway and raises (opens) to allow a vehicle to pass.

The ground-based vehicle barrier system 300, as shown in FIG. 2, comprises one or more bollards 20 that may rise from the road at a location before the gateway to prohibit passage of the vehicle 110. In an example, the bollards 20 may be installed into the ground about four feet apart or less depending on the type(s) of vehicle traffic in an area. When the bollards 20 are raised, this is referred to as an extended position. When the bollards 20 are lowered, this is referred to as a recessed position. Moreover, the ground-based vehicle barrier system 300 further comprises a series of housings 10 to accommodate the series of bollards 20 while the bollards 20 are in their recessed positions.

Figure 3:
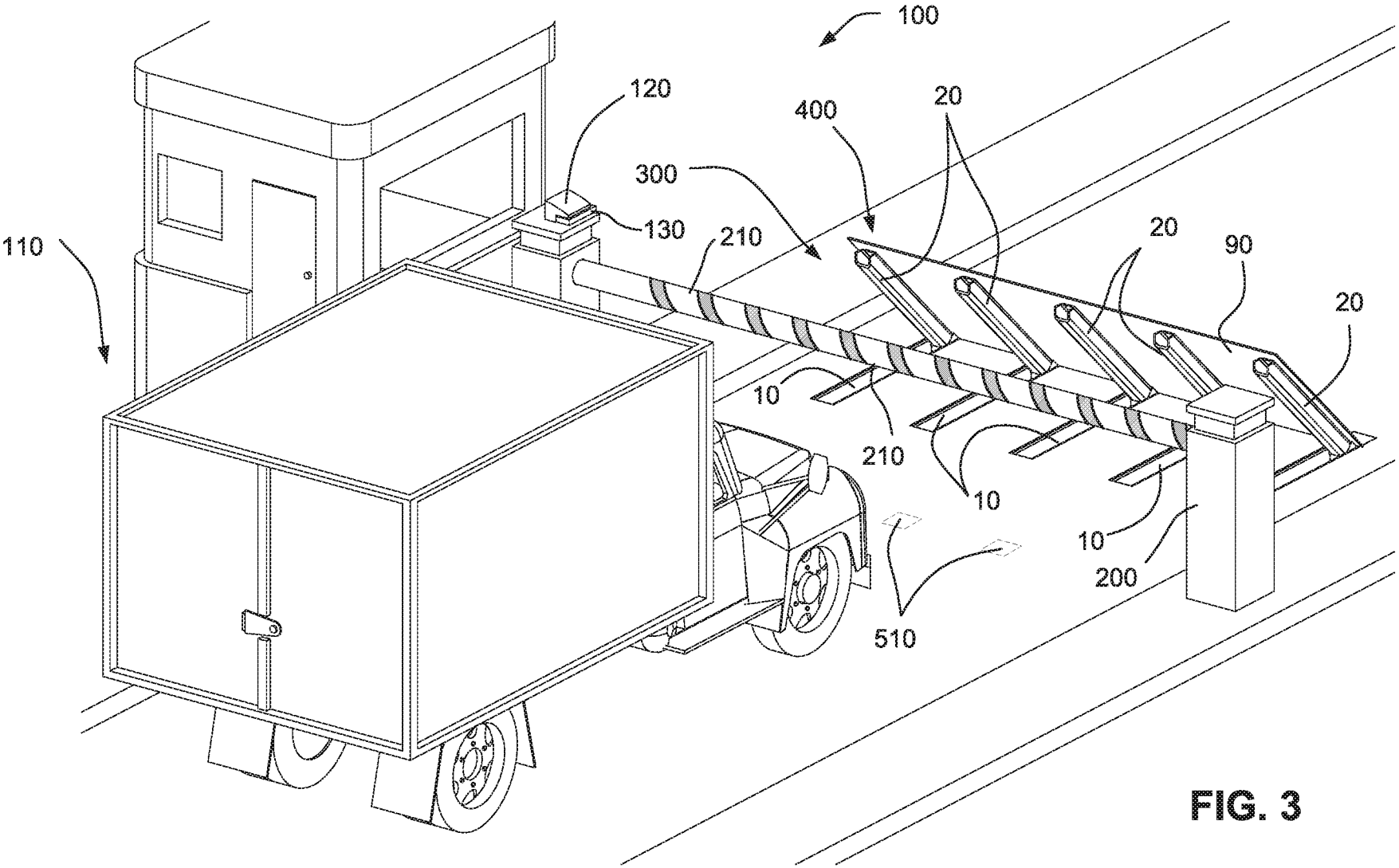
FIG. 3 shows a non-limiting, exemplary scenario for an exemplary security system including an example ground-based vehicle barrier system.
Figure 4:
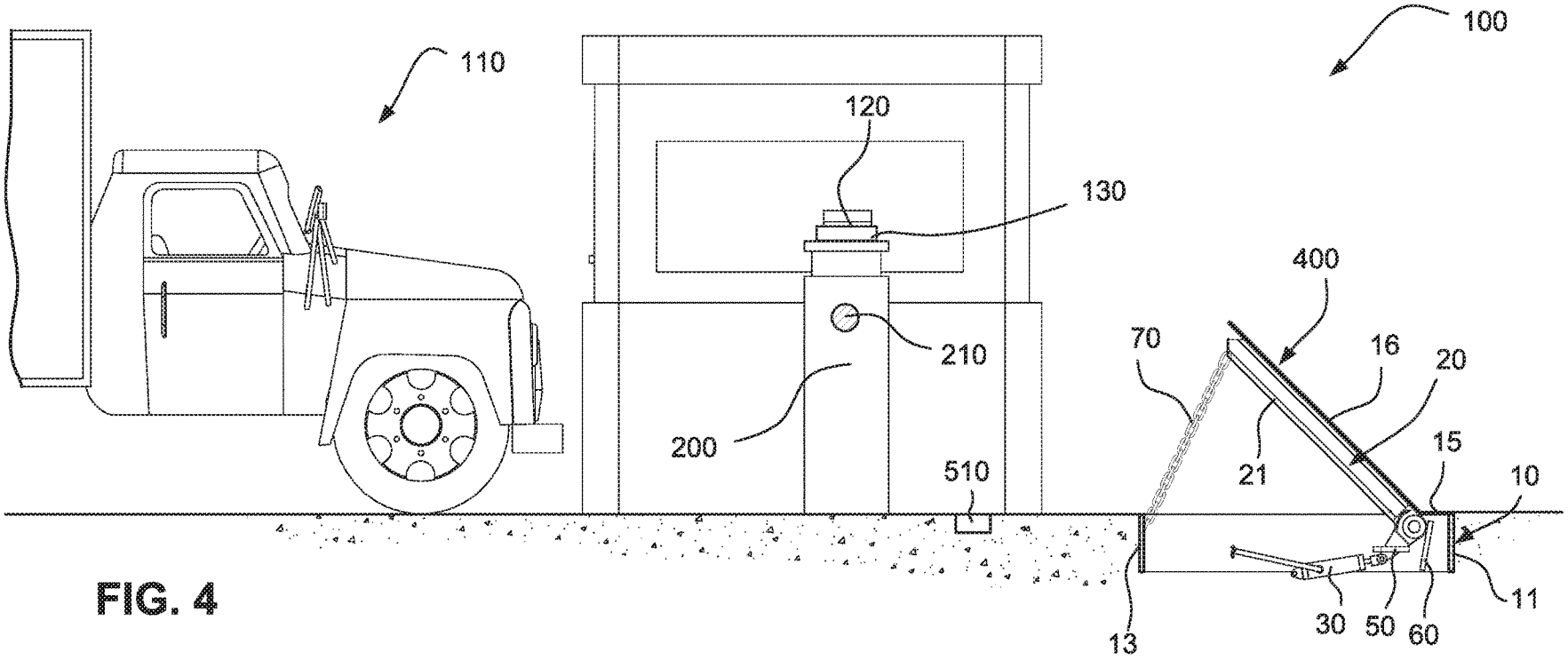
FIG. 4 shows a non-limiting, exemplary scenario for an exemplary security system including an example ground-based vehicle barrier system.

In the examples shown in FIGS. 1-4, each of the bollards 20 may be covered by and/or attached to a plate, which has the same width as the holding through where the bollard is situated in the pavement until raised. In the ground-based vehicle barrier system 300 shown in FIGS. 1-2, the one or more bollards 20 are not covered by or attached to a common plate, and hence each of the bollards 20 may switch between the recessed and extended positions independently, if necessary. In an example, the movement of the bollards may be controlled by one or more controllers, each of which controls one or more bollards independently. Another exemplary ground-based vehicle barrier system 400 as shown in FIGS. 3-4 comprises a panel 90 (e.g., a metal plate) positioned across the road which may angle up. The panel 90 is fixedly coupled to one or more bollards 20. In its recessed position, the panel 90 lies flat on the road when the bollards 20 are lowered. In its extended position, the panel 90 angles up, e.g., about three to four feet high and/or to form a 45 degree angle between the panel and ground.

The ground-based vehicle barrier systems 300 and 400 as shown in FIGS. 1-4 are installed into the ground or built into the landscape/streetscape. In certain examples, the panel 90 and/or one or more bollards 20 may be embedded in a concrete foundation. The bollards 20 would be generally installed in the pavement about four feet apart or less depending upon the type(s) of vehicle traffic in the area. The panel 90 and/or one or more bollards 20 may stop a vehicle that collides with it through impact resistance.

The ground-based vehicle barrier system 400 may be actuated upon a command from a remote controller 511 (FIGS. 1-2) operated by a security guard or an automated controller including sensors 510 and/or controls to allow or prohibit passage of the vehicle 110 as appropriate.

The gate control system 200 and/or the ground-based vehicle barrier system 300 may use a terminal 120 adapted to receive input from a driver of the vehicle 110. The terminal 120 may be positioned in any desired locations, such as next to the vertically rotating arm 210 of the gate control system 200. Alternatively, there might be multiple terminals for the gate control system 200 and/or the around-based vehicle barrier system 300 as well. In some examples, the terminal 120 may be adapted to communicate automatically with one or more systems and/or devices associated with the vehicle 110 without input from the driver. For example, the terminal 120 may communicate with a radio frequency identification (RBI)) system coupled to the vehicle 110 to automatically authenticate the vehicle 110 for passing through the gateway. In an alternative example, the driver may also provide an input to the terminal 120 by entering a code, inserting a validation ticket, scanning a barcode, scanning an RFID badge, and/or entering biometric information.

The security system 100 may further comprise a controller 130 coupled with a memory storing instructions for causing the security system 200 to successfully identify or authenticate the driver, based on the input from the driver, prior to permit the passage of the vehicle 110. The controller 130 of the security system 100 is adapted to analyze the information collected from the driver by the terminal 120 or automatically from a system/device associated with the vehicle 110 to authenticate the vehicle 110 for passage. Successful authentication in this manner may be required prior to permitting vehicle passage by the gate control system 200 and/or the ground-based vehicle barrier system 300.

In examples, the controller 130 for the ground-based vehicle barrier system 300 is configured to receive a command from a remote controller 511 operated by a security guard or authorized personnel. In yet another example, the controller 130 for the ground-based vehicle barrier system 300 may analyze information collected by one or more sensors 510 or other controls to control passage of the vehicle 110 as appropriate.

In certain examples, the controller 130 of the security system 100 may control not only the vertically rotating arm 210 of the gate control system 200, but also a drive (not shown) of the ground-based vehicle barrier system 300. In an alternative example, the ground-based vehicle barrier system 300 may have a separate controller, which is independent from a controller for the gate control system 200. The controller 130 may be housed in a stand-alone device located in the ground or within a guardhouse, a sentry station or the like. Alternatively, the controller 130 may be disposed within one or more housings 10 of the ground-based vehicle barrier system 300.

In an alternate example, the security system 100 may only include the ground-based vehicle barrier system 300, without the vertically rotating arm 210. The ground-based vehicle barrier system 300 in this example is used as a traffic deterrent, as well as a hard stop barrier in road lanes, accompanied by a LED light and a camera disposed on the distal end of one or more of the bollards 20. In an example, there may be a substantially constructed control box to operate the bollards 20, which can be individually, or several in a sequence. This example allows traffic to pass with two or more of the bollards 20 disengaged.

Figure 5:
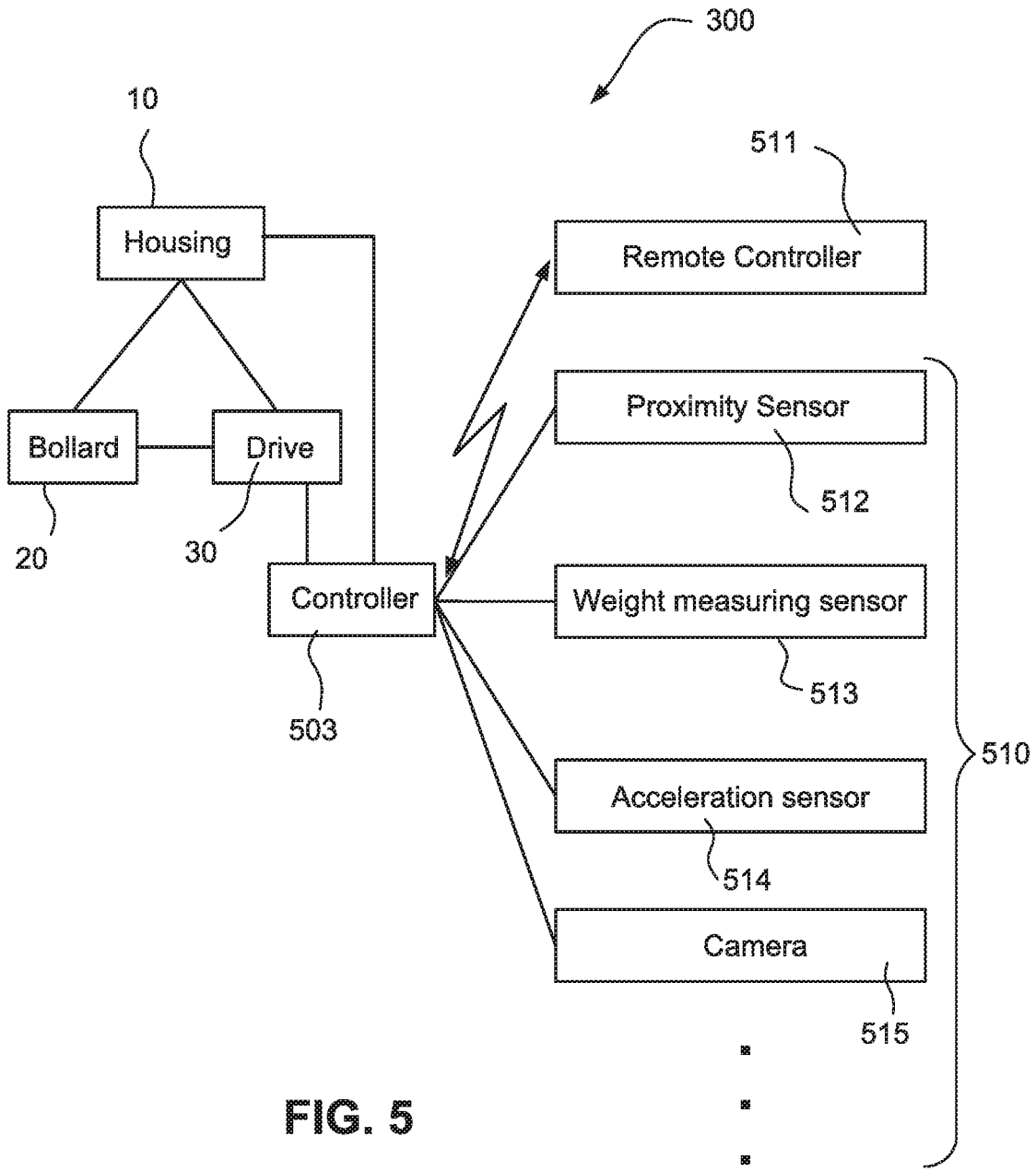
FIG. 5 shows a block diagram of an example ground-based vehicle barrier system.

FIG. 5 illustrates a non-limiting, exemplary block diagram for the ground-based vehicle barrier system 300. Some examples may have different and/or other sub-modules than the ones described herein. Similarly, the functions can be distributed among the sub-modules in accordance with other examples in a different manner than is described herein.

The ground-based vehicle barrier system 300 comprises at least one bollard 20 movable (e.g., pivotably) between a recessed position permitting vehicle passage and an extended position inhibiting vehicle passage. In an example, the bollard 20 may be retained in its recessed position until a vehicle driver seeks to traverse the barrier at high speed without presenting proper identification or authorization to proceed. This example can be applied in high traffic areas or the like. Alternatively, a security guard may retain the ground-based vehicle barrier system 300 in its extended position until a vehicle approaches the barrier and the driver presents proper identification or authorization to proceed. In yet another example, the ground-based vehicle barrier system 300 may be selectively extended, such that vehicles may pass during selected times (e.g., when the bollard 20 is in its recessed position), while being prevented from passing during other selected times (e.g., when the bollard 20 is in its extended position).

1) Detailed Structure of an Example Barrier System

Detailed structure of the example ground-based vehicle barrier system 300 will be described below with reference to FIGS. 6-9 and 11. In particular, FIG. 6 shows a perspective view of the example ground-based vehicle barrier system 300, FIG. 7 shows a cut-away view the ground-based vehicle barrier system 300, FIG. 8 shows an exploded view of the ground-based vehicle barrier system 300, and FIG. 9 shows an exploded view of the bollard 20.

Figure 6:
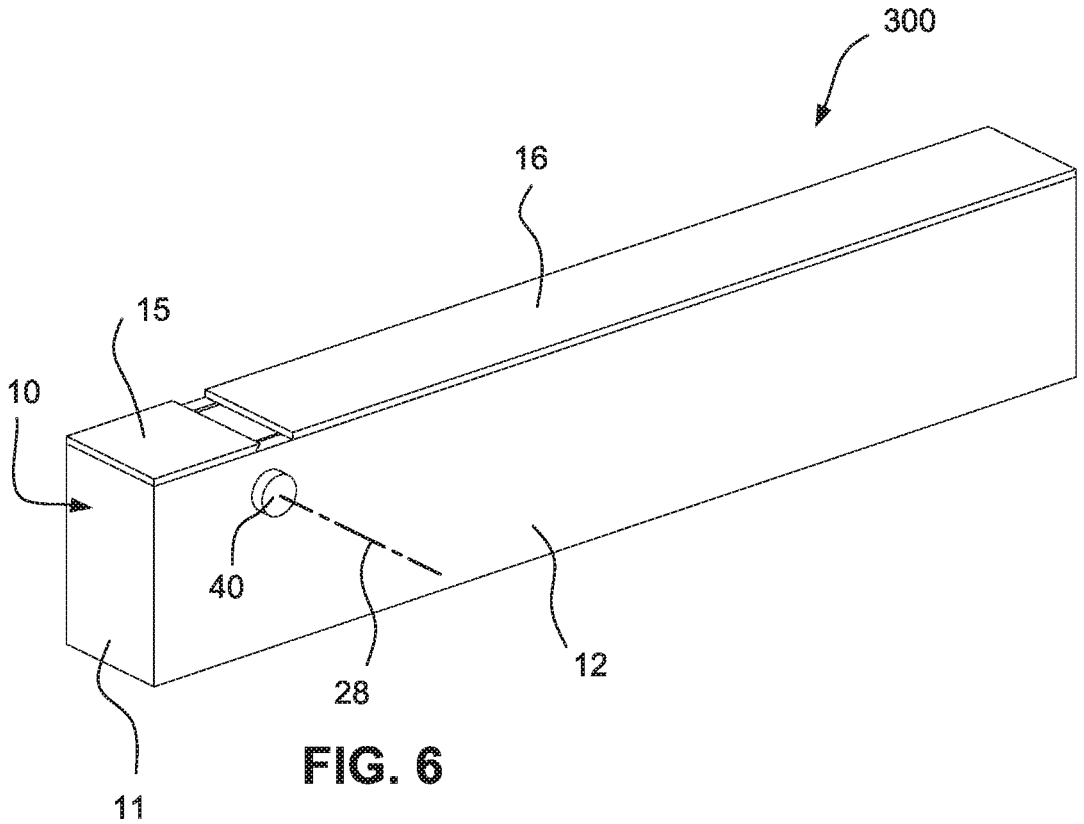
FIG. 6 shows a perspective view of a non-limiting, exemplary ground-based vehicle barrier system.
Figure 7:
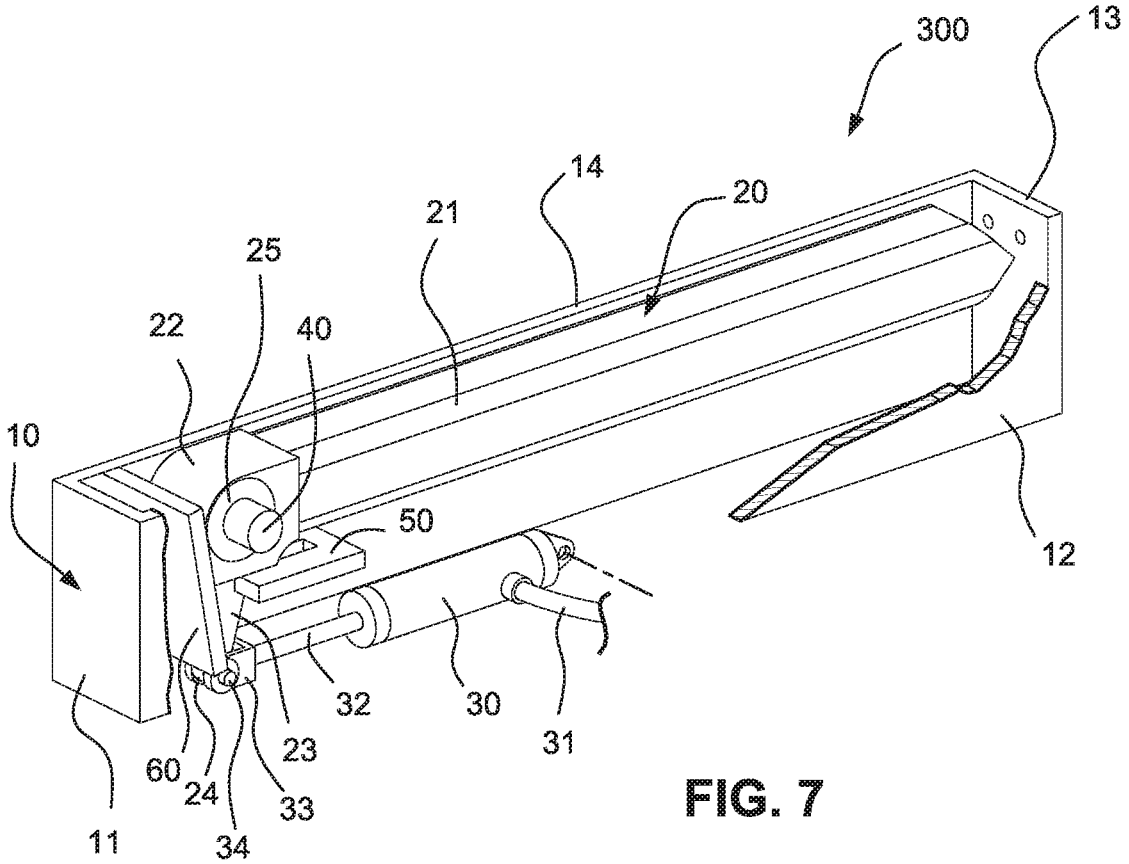
FIG. 7 shows a cut-away view a non-limiting, exemplary ground-based vehicle barrier system.
Figure 8:
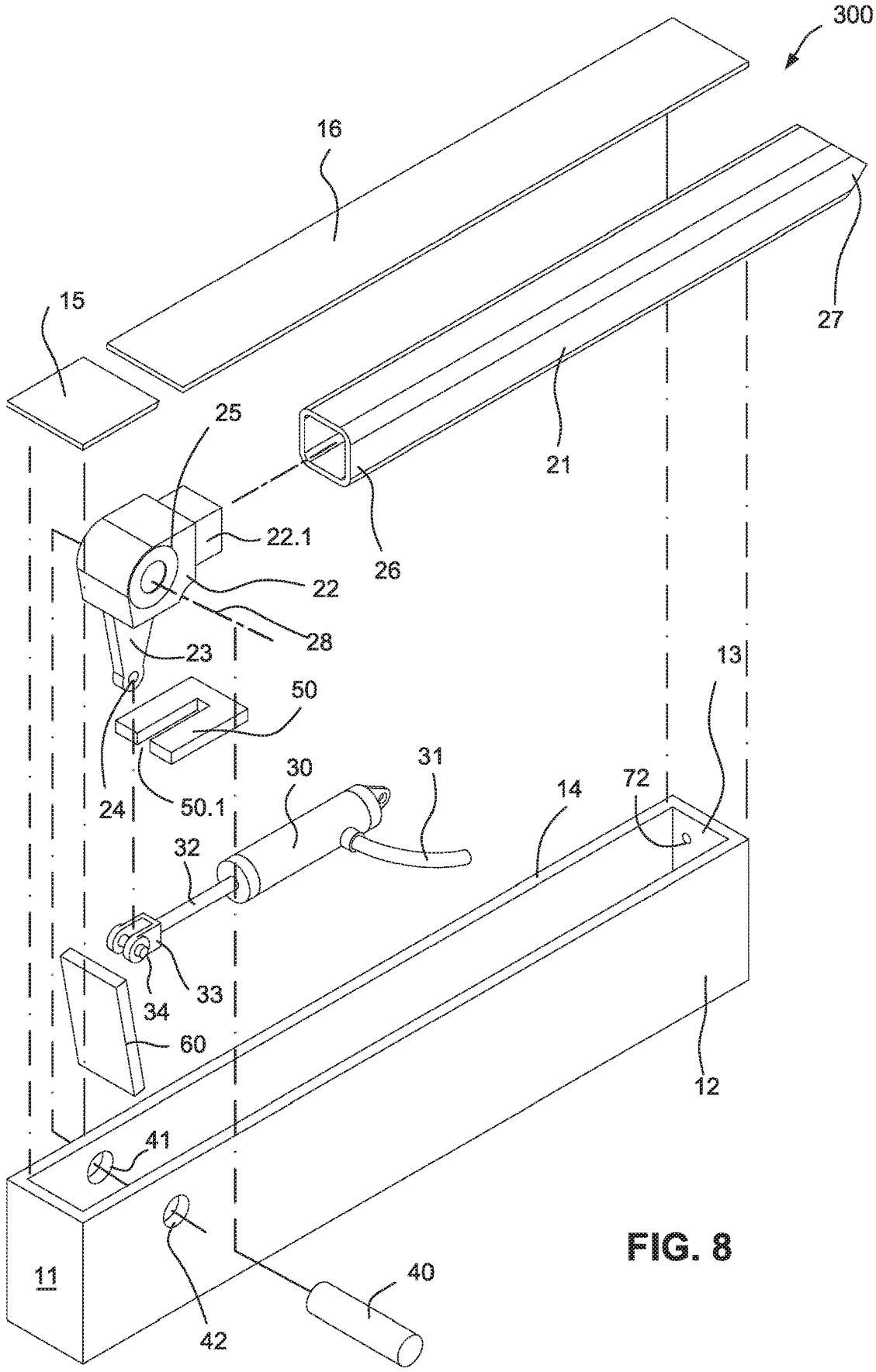
FIG. 8 shows an exploded view of a non-limiting, exemplary ground-based vehicle barrier system.
Figure 9:
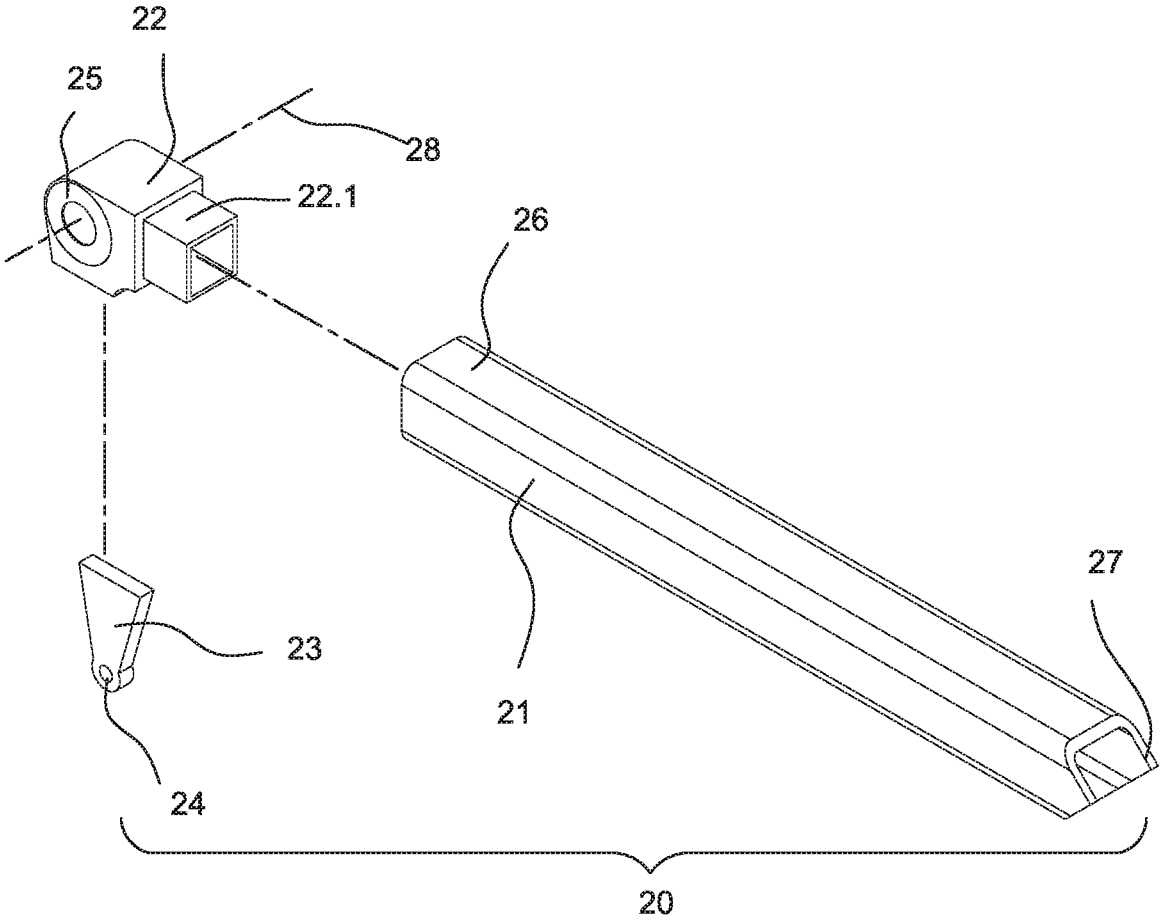
FIG. 9 shows an exploded view of a non-limiting, exemplary bollard.

As shown in FIGS. 6-8, the ground-based vehicle barrier system 300 comprises the housing 10, the movable (e.g., pivotably) bollard 20, and a drive 30 connected to the bollard 20. The bollards 20 may comprise solid steel or any other materials. The bollard 20 is pivotably movable about a pivot axis 28 between a recessed position permitting vehicle passage and an extended position inhibiting vehicle passage. However, the bollard 20 does not need to be pivotable as it could include a pin that slides along a slot. In an example, the bollards 20 may rise from the road about three to four feet high, and/or a 45 degree angle may be formed between the bollards 20 and the ground. The drive 30 is configured to selectively move the bollard 20 in the recessed and extended positions, by rotating about a pivot axis or by moving about a pin that slides along a slot.

The bollard 20 is accommodated by the housing 10 when it is in its recessed position. The housing 10 may comprise solid steel or any other materials. The housing 10 includes a front end 13, a back end 11 and two sides 12 and 14 forming an elongated space to accommodate the bollard 20 while the bollard 20 is in its recessed position. The housing 10 may further comprise top lids 15 and 16, each of which may cover a portion of the housing 10. In certain examples, the top lids 15 and 16 may be coupled with or replaced by a panel (e.g., a metal panel 90 in FIG. 3) covering the ground-based barrier system 300.

In an example, the ground-based vehicle barrier system 300 further comprises a pivot shaft 40 supported by the two sides 12 and 14 of the housing 10 via two holes 41 and 42 opened on the two sides 12 and 14, respectively. The shaft may have a diameter about 2-5 inches, e.g., 2 inches. The central axis of the pivot shaft 40 is substantially aligned with the pivot axis 28, about which the bollard 20 rotates. Thus, the bollard 20 is configured to rotate about the pivot shaft 40 between the recessed and extended positions. The shaft may also help resist impact forces applied to the bollard 20 when the bollard is in its extended position and a vehicle impacts the bollard 20.

Further details of the structure of the bollard 20 is illustrated by an exploded view depicted in FIG. 9. The bollard 20 comprises a sleeve 21, an elbow piece 22, and a link 23 connecting the bollard 20 to the drive 30. The sleeve 21 has a proximal end 26 and a distal end 27. In certain examples, as shown in FIGS. 8 and 9, the sleeve 21 is hollow. Alternatively, the sleeve 21 may comprise substantially solid metal, although, in some examples, the sleeve 21 may still have one or more hollow spaces for installing a camera, LED light(s), and/or sensors. In an example, the elbow piece 22 includes an insert portion 22.1 inserted into the proximal end 26 of the sleeve 21, and hence it connects the proximal end 26 of the sleeve 21 with the link 23 of the bollard 20. In an example, at least a portion of the link 23 is thinner than the major portion of the elbow piece 22. In some example embodiments, the elbow piece 22 and the link 23 are constructed as one piece arrangement. In other examples, the elbow piece 22 and the link 23 can be made separately and attached as an integral assembly.

As shown in FIGS. 7-8, the link 23 extends transverse to the sleeve 21 and has a connection point 24 connecting to one end of the drive 30. In an example, the drive 30 is connected to the connection point 24 via a pair of mounting brackets 33 and a pin 34 inserted therethrough. When the bollard 20 is in the recessed position, the connection point 24 and the pivot axis 28 are substantially vertically aligned.

In an example, the thickness of the sleeve 21 is reduced at the distal end 27, so that the ground-based vehicle barrier system 300 may not only stop a vehicle, but also make the vehicle stuck there or even puncture the vehicle's tires. When the bollard 20 is actually in its extended position and the vehicle is struck, the weight of the vehicle is transferred in collision as part of the weight of the bollard 20.

Figure 12:
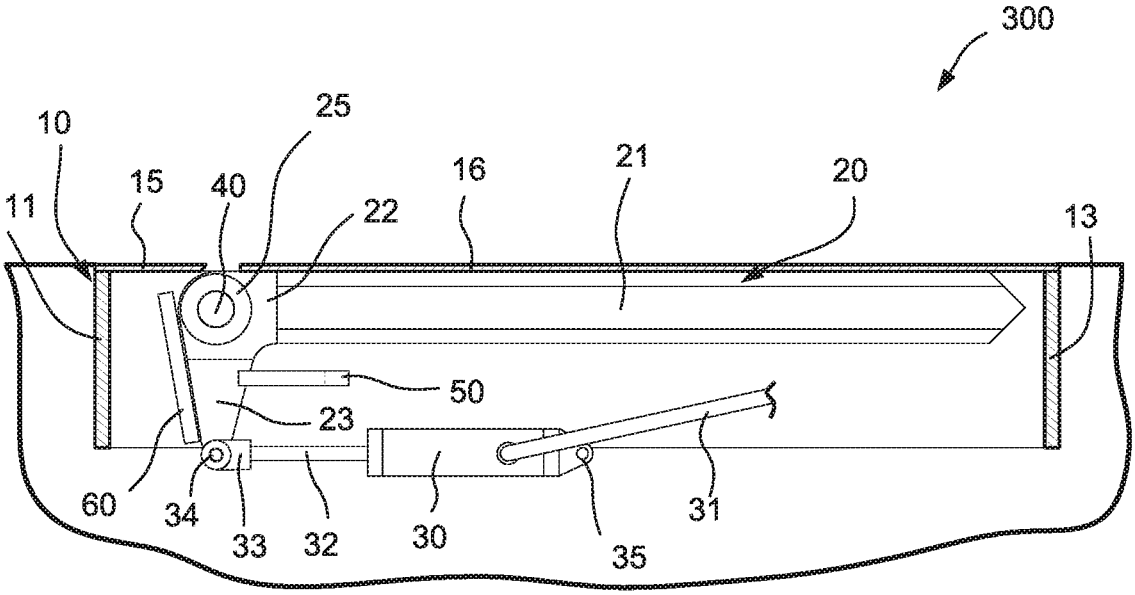
FIG. 12 shows a section view of a non-limiting, exemplary ground-based vehicle barrier system.
Figure 13:
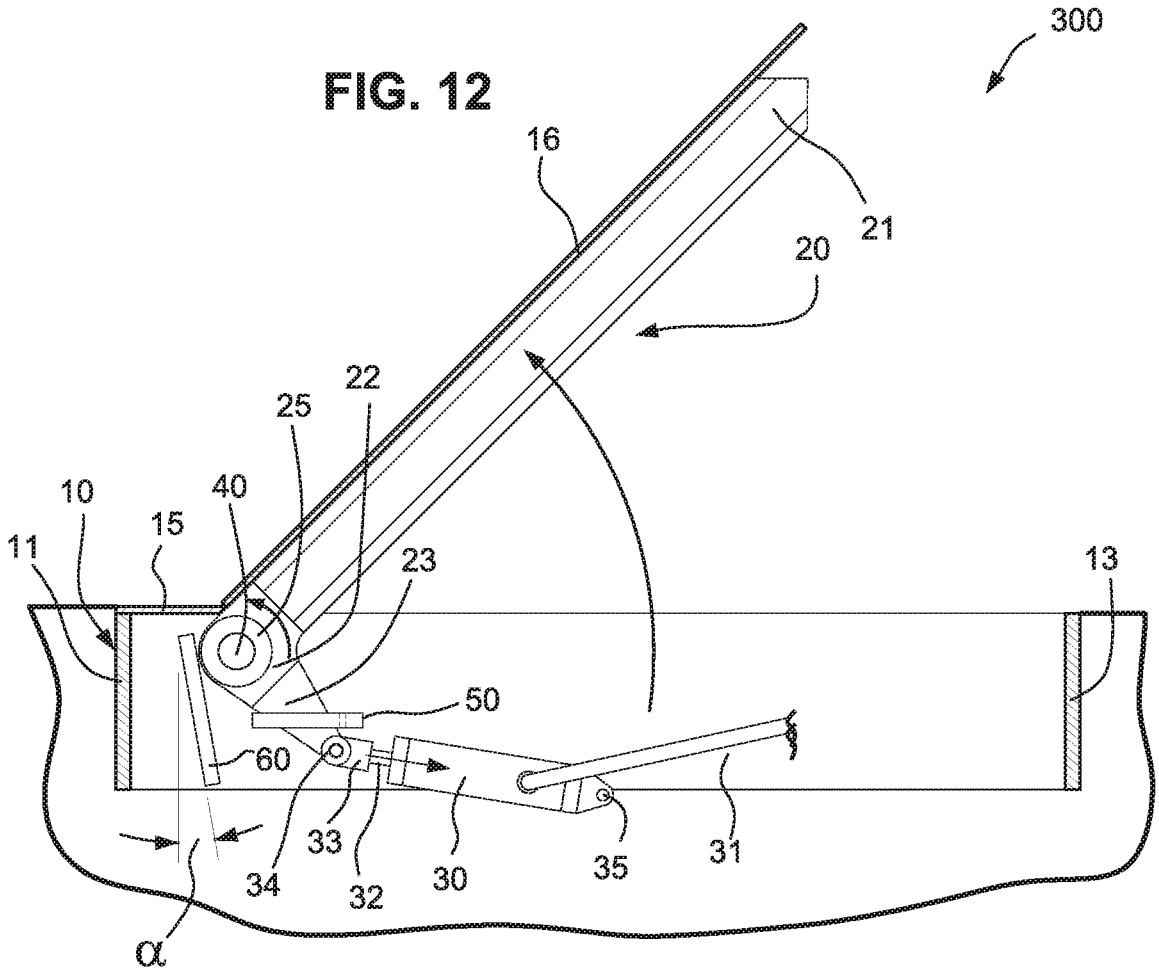
FIG. 13 shows a section view of a non-limiting, exemplary ground-based vehicle barrier system.

As shown in FIGS. 7-8, the ground-based vehicle barrier system 300 may further comprise a backup member 60 beside the elbow piece 22 of the bollard 20 and a guide 50 beside the link 23. The backup member 60 and the elbow piece 22 are fixedly attached to the housing 10, for example, via welding. In an example, while the bollard 20 is pivotably moving about the pivot axis 28 between the recessed and extended positions, the backup member 60 is configured to restrict rearward movement of the bollard 20, and the guide 50 is configured to restrict lateral movement of the link 23 and stop for upward amount of slope. For example, as shown in FIGS. 12-13, when the bollard 20 is in its recessed position, both the elbow piece 22 and the link 23 of the bollard 20 almost come into contact with the backup member 60, to help maintain the bollard 20 in a horizontal position when recessed. Furthermore, when the bollard 20 is in its extended position, the link 23 is moved away from the backup member 60, but is received within a slot 50.1 of the guide 50. However, a rear surface of the elbow piece 21 stays in contact with or in a close proximity to the backup member 60. The backup member 60 may be angled towards the rear at an angle α about 3~10° (e.g., 5°).

As detailed in FIG. 8, the guide 50 is rectangular in cross-section and is open at one side to define the slot 50.1. In certain examples, the width of the guide 50 (e.g., d8 in FIG. 11) is about 4.5~6.5 inches, the length of the guide 50 (e.g., d7 in FIG. 11) is about 6.5~8.5 inches, and the width of the open slot 50.1 (e.g., d6 in FIG. 11) at one side is about 0.5~2.5 inches.

The backup member 60 and the guide 50 may be of any shape and size. In alternative examples, the backup member 60 and the guide 50 may be located in other locations in the housing 10 to restrict the movement of the bollard 20.

Figures 10, 11:
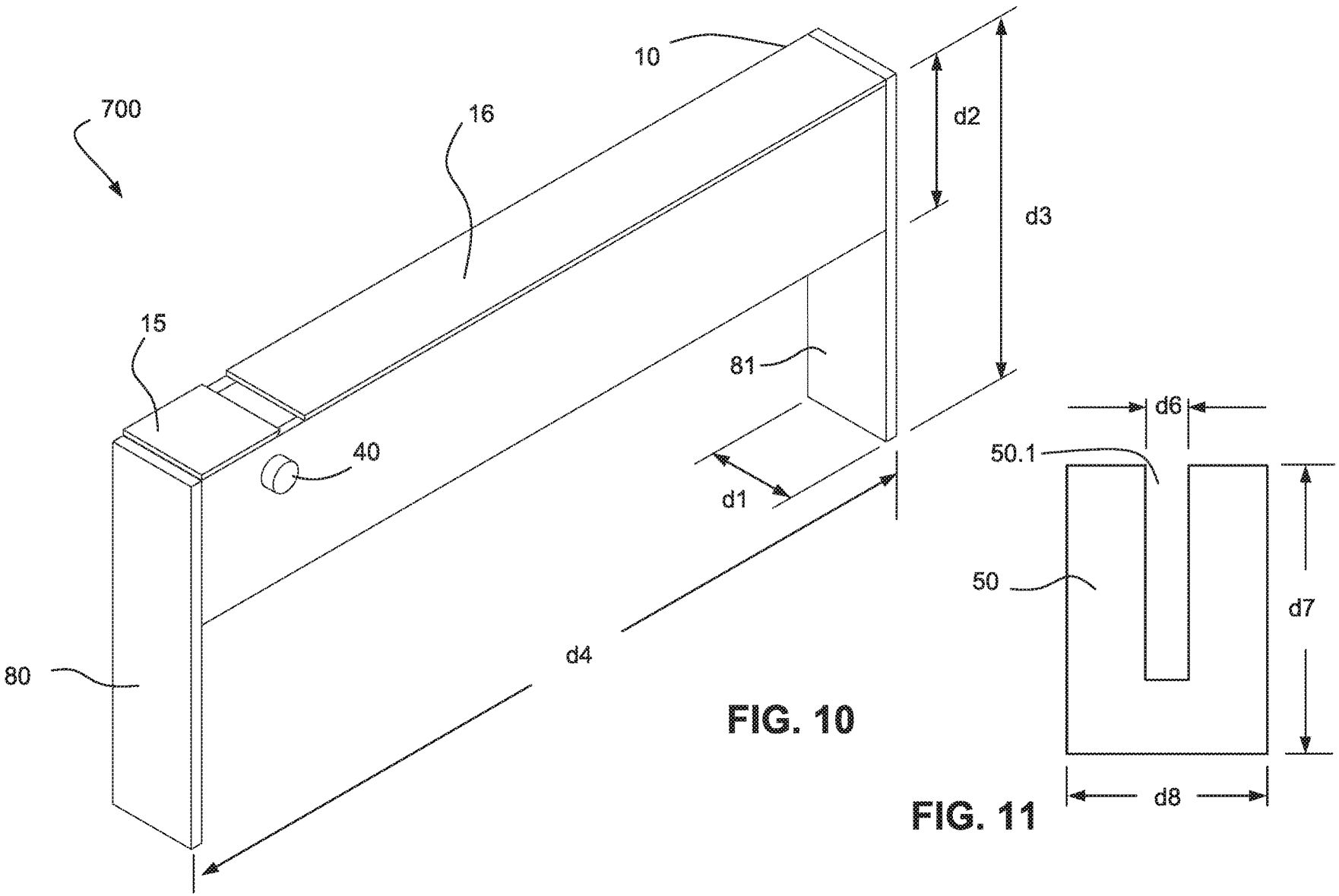
FIG. 10 shows a perspective view of a non-limiting, exemplary ground-based vehicle barrier system.
FIG. 11 shows a perspective view of a non-limiting, exemplary guide.

FIG. 10 shows a perspective view of another exemplary ground-based vehicle barrier system 700. In this example, the ground-based vehicle barrier system 700 further comprises one or more anchor members 80 and 81 connected to the front end 13 and back end 11 of the housing 20. Similar to those examples illustrated in FIGS. 1-4, the ground-based vehicle barrier system 700 may be buried into the ground or built into the landscape/streetscape. For example, the ground-based vehicle barrier system 700 may be embedded in a concrete foundation. The anchor members 80-81 are adapted to fix the housing 10 of the ground-based vehicle barrier system 700 into the ground. In this way, the bollard 20 may bring a vehicle to a halt through impact resistance, and rely on the inertia of the foundation to stop vehicles.

FIG. 10 also illustrates dimensions of the ground-based vehicle barrier system 700. The width of the housing 10 (e.g., d1 in FIG. 10) may be about 6.5~8.5 inches, the length of the housing 10 (e.g., d4 in FIG. 10) may be about 60~70 inches, and the height of the housing 10 (e.g., d2 in FIG. 10) may be about 10~14 inches. The thickness of the front end 13, back end 11 and two sides 12 and 14 of the housing 10 may be about 0.8~1.2 inches. The length of the bollard 20 may be around 45~60 inches, and the thickness of the sleeve 21 of the bollard 20 is about 5~6 inches.

In this example, the width of the anchor members 80 and 81 are the same as the width of the housing 10 (e.g., d1 in FIG. 10), and the length of the anchor members 80 and 81 (e.g., d3 in FIG. 10) is about 27~33 inches.

2) An Example Drive of the Barrier System

The ground-based vehicle barrier system 300 may comprise one or more bollards 20 and/or a panel fixedly coupled with one or more bollards 20, which are typically heavy, and hence require the drive 30 to raise and lower at least one of the bollards 20 and/or the panel. The drive 30 is connected to the bollard 20 for moving the bollard 20 between its recessed and extended positions. The drive 30 may be disposed within the housing 10 or outside of the housing 10. In an example, the drive 30 is a hydraulic cylinder, such as a piston and rod assembly (e.g., filled with gas, light oil or explosive type of charge), for selectively moving the bollard 20 in the recessed and extended positions. In other examples, the drive 30 may be an electric motor, a gear assembly, a spring based system, a spring leased system, or other kinds of drive.

In FIGS. 7-8 and 10-11, the drive 30 is a hydraulic cylinder. The hydraulic cylinder 30 comprises a cylinder barrel, in which a piston connected to a piston rod 32 moves back and forth. The cylinder barrel is closed on one end by the cylinder bottom and the other end by the cylinder head where the piston rod 32 comes out of the cylinder. In certain examples, the bottom of the hydraulic cylinder 30 is anchored to the housing 10 via a connection point 35 of the hydraulic cylinder 30. For example, the ground-based vehicle barrier system 300 may further comprise a rod (not shown in the figures) fixed to and supported by the two sides 12 and 14 of the housing 10, and the rod passes through the connection point 35 of the hydraulic cylinder 30 and the two sides 12 and 14 of the housing 10 to anchor the hydraulic bottom to the housing 10. A rod connected with the connection point 35 of the hydraulic cylinder 30 may also be fixed into the ground in alternate examples. The hydraulic cylinder 30 may be anchored to the ground-based barrier system 300 by any other mechanisms. Further, the width of the hydraulic cylinder 30 may be around 2.5~3.5 inches, and the length of the hydraulic cylinder 30 may be around 10~14 inches.

The hydraulic cylinder 30 gets its power from pressurized hydraulic fluid, such as lightweight oil, compressed air (e.g., Nitrogen), or explosive charge. The pressurized hydraulic fluid is received via a pipe or tube 31 of the hydraulic cylinder 30. The piston then moves back and forth due to pressure differences between two sides of the piston. Since the piston rod 32 connects the piston to one end of the link 23 of the bollard 20, the back and forth movement of the piston therefore causes the movement of the bollard 20 between the recessed and extended positions. In one example, when the piston rod 32 extends out of the cylinder, the bollard 20 is in its recessed position, and when the piston rod 32 retracts back to the cylinder, the bollard 20 is in its extended position. Moreover, when the bollard 20 is in its extended position, the piston rod 32 may not be easily broken by the impact of the vehicle, as the portion of the piston rod 32 exposed outside of the cylinder barrel is very short. In an alternate example, the bollard 20 may be moved by the hydraulic cylinder 30 in a different way, for example, it will be in its recessed position when the piston rod 32 retracts back to the cylinder.

The back and forth movement of the piston may vary when different kinds of hydraulic fluids are used by the hydraulic cylinder 30. For example, the movement of the piston may be relatively slow when lightweight oil or gas is filled into the cylinder 30. In contrast, the movement of the piston may be sudden and unexpected when explosive type of charge in the cylinder 30 is fired. As a result, the movement of the bollard 20 controlled by the cylinder 30 may also be different when different types of fluids are used. In one example, it may take about one second or longer to raise one of the bollards 20 when air (e.g., Nitrogen) is used. In another example, the bollard may raise up suddenly when explosive type of charge is used and then causes the sudden movement of the piston.

3) Movement of the Example Bollard

FIG. 12 and FIG. 13 show a section view of the ground-based vehicle barrier system 300 while the bollard 20 is in its recessed position and its extended position respectively. These figures particularly show positions of the elbow piece 22 and link 23 of the bollard 20 relative to the backup member 60 and guide 50. In other examples, the positions of the elbow piece 22 and link 23 of the bollard 20 may be different relative to the backup member 60 and the guide 50.

In FIG. 12, when the bollard 20 is in its recessed position, both the elbow piece 22 and the link 23 of the bollard 20 are in proximity with the backup member 60, but the link 23 is moved away from or partially within the slot of the guide 50.

In certain example embodiments, when a vehicle is approaching the barrier system 300 without authorization, the piston within the hydraulic cylinder 30 will be manually or automatically controlled to move backward, and hence the piston rod 32 connected with the piston will move backward as well. As a result, the backward movement of the piston rod 32 pulls the link 23 toward the guide 50, and then causes the elbow piece 22 to raise up. As shown in FIG. 13, when the bollard 20 is raised up to its extended position, the link 23 is moved away from the backup member 60, and inserted closer to the guide 50. In an example, when the bollard is in its extended position, an acute angle (e.g., a 45 degree angle) or a vertical angle may be formed between the bollard 20 and the ground.

The barrier system 300 is constructed to resist impact forces applied to it when the bollard 20 is in its extended position. In some examples, the bollard 20 is connected to the drive 30, e.g., via a connection mechanism between the link 23 and the rod 32, and the drive 30 is fixed to the housing 10 at least at one end. Thus, the bollard 20 in its extended position is also indirectly anchored to the housing 10, and hence it can resist certain impact forces from the vehicle when a vehicle impacts the bollard. Moreover, the shaft 40 or a pin on a slot, about which the bollard 20 rotates, is supported by the two sides 12 and 14 of the housing 10, so that it may also contribute to reinforcement of the extended bollard 20 in the event of impact as well. Furthermore, the guide 50 and backup member 60 are also constructed to help resist impact forces applied to the raised bollard 20. Both the guide 50 and backup member 60 are anchored to the housing 10. In an example, the guide 50 is configured to not only to limit excessive vertical movement of the sleeve 21, but also restrict movement of the link 23. As the link 23 is received within the slot 50.1 of the guide 50, the slot 50.1 helps restrict lateral and/or excessive vertical movement of the link 23 caused by impact forces applied by vehicles from different angles. Similarly, the backup member 60 may be at least partially in contact with the rear surface of the elbow piece 22 of the bollard 20 in its extended position, and hence may restrict rearward movement of the bollard and help stop the bollard 20 from further extension. The backup member, bollard, elbow, side wall(s), shaft and/or chain may be arranged to help counteract forces due to vehicular impact.

Under other circumstances, e.g., if the vehicle is no longer in proximity to the barrier system, the piston of the hydraulic cylinder 30 will be controlled to move forward, and the forward movement of the piston will push the link 23 toward the backup member 60, so that the elbow piece 22 of the bollard will drop down again and the bollard 20 goes back to its recessed position shown in FIG. 12.

4) Example Chains

Figure 14:
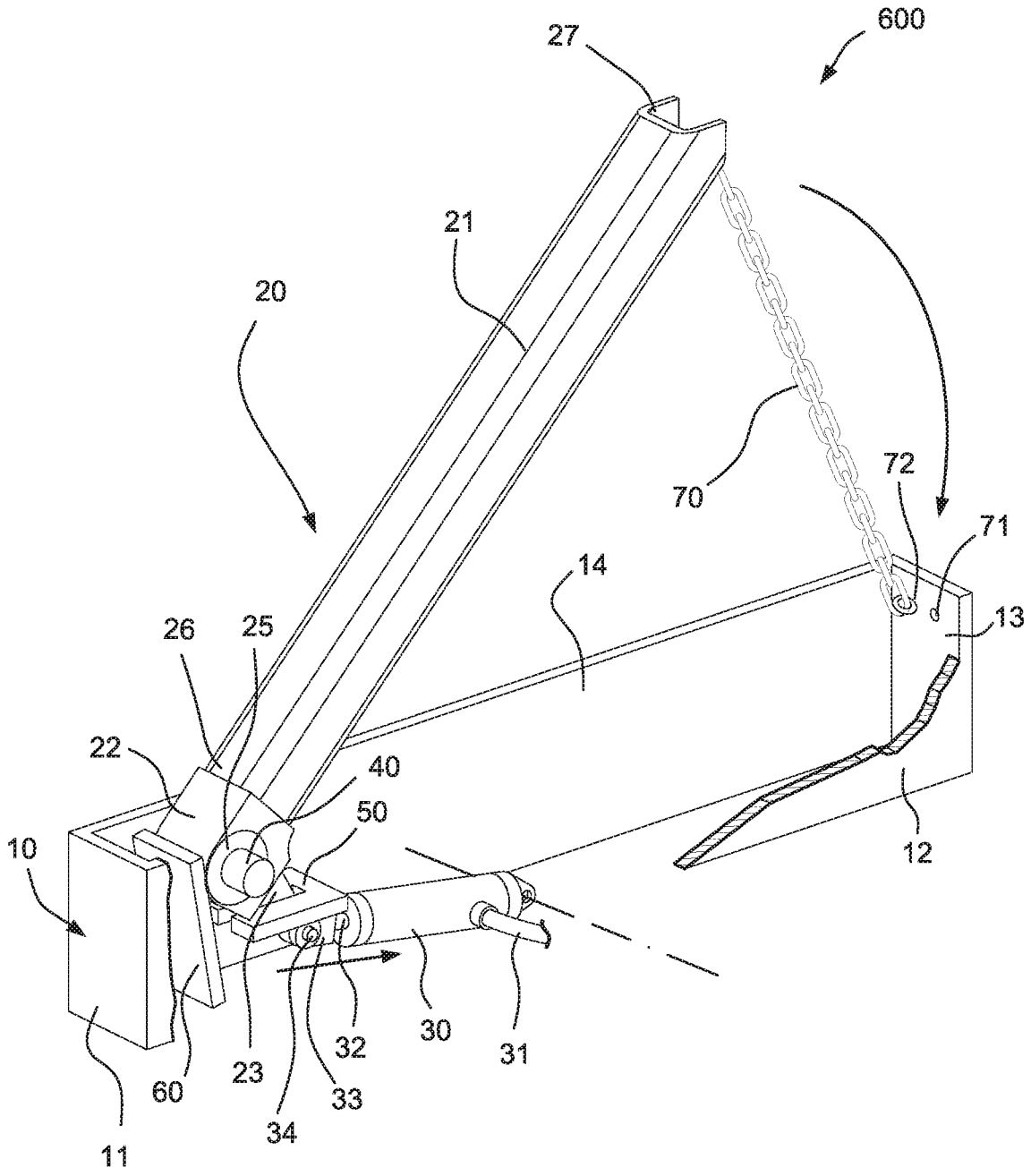
FIG. 14 shows a cut-away view of a non-limiting, exemplary ground-based vehicle barrier system.
Figure 15:
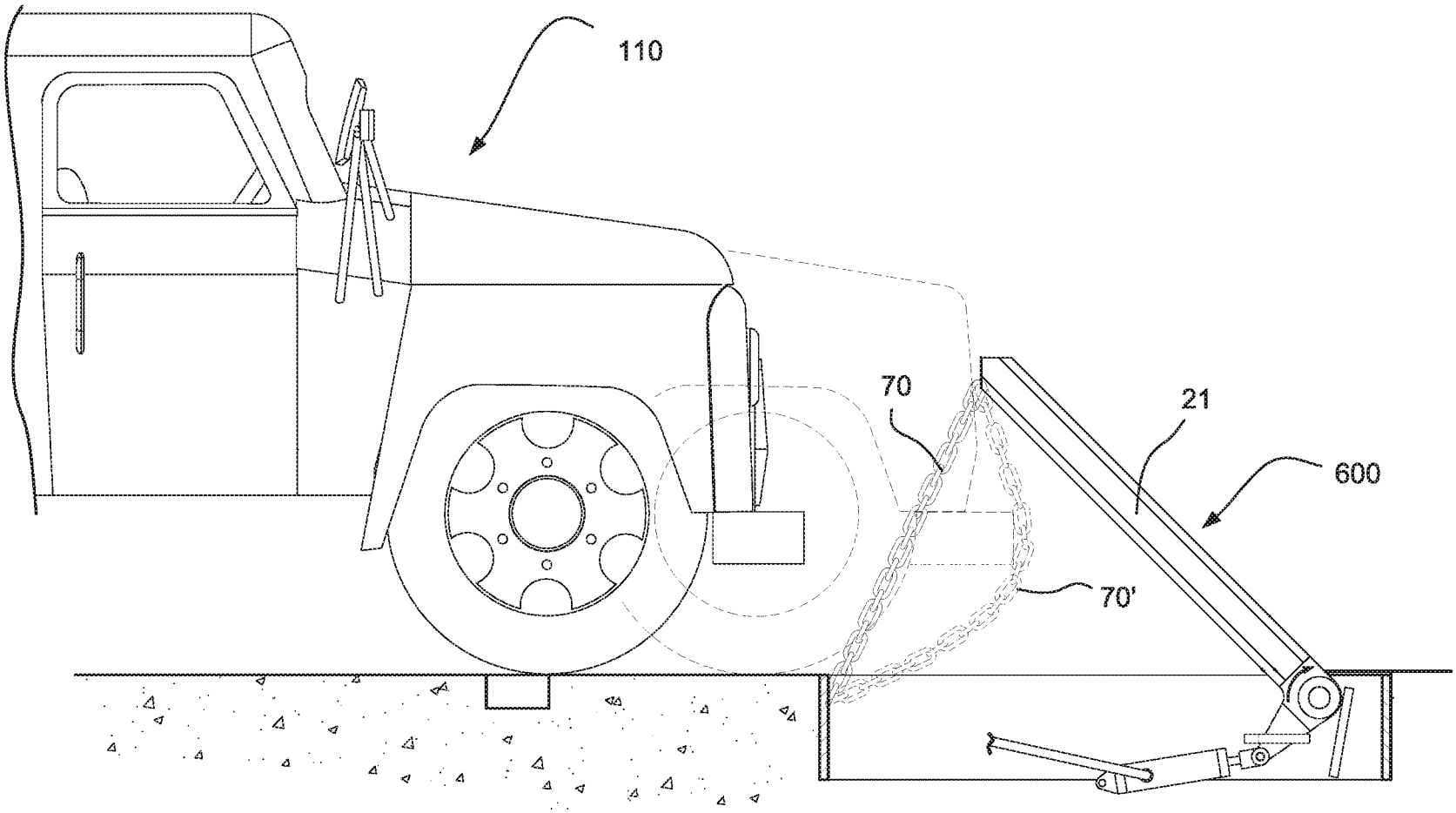
FIG. 15 shows a perspective view of a non-limiting, exemplary ground-based vehicle barrier system.

In an example ground-based vehicle barrier system 600 shown in FIGS. 14-15, an optional chain 70 or wire ropes of various sizes may be coupled between the front end 13 of the housing 10 and a distal end 27 of the sleeve 21. The chain 70 may comprise solid steel or any other materials. The chain 70 or wire rope may be strung along the arm of an individual bollard to art as a motorcycle or bicycle barrier.

Figure 18:
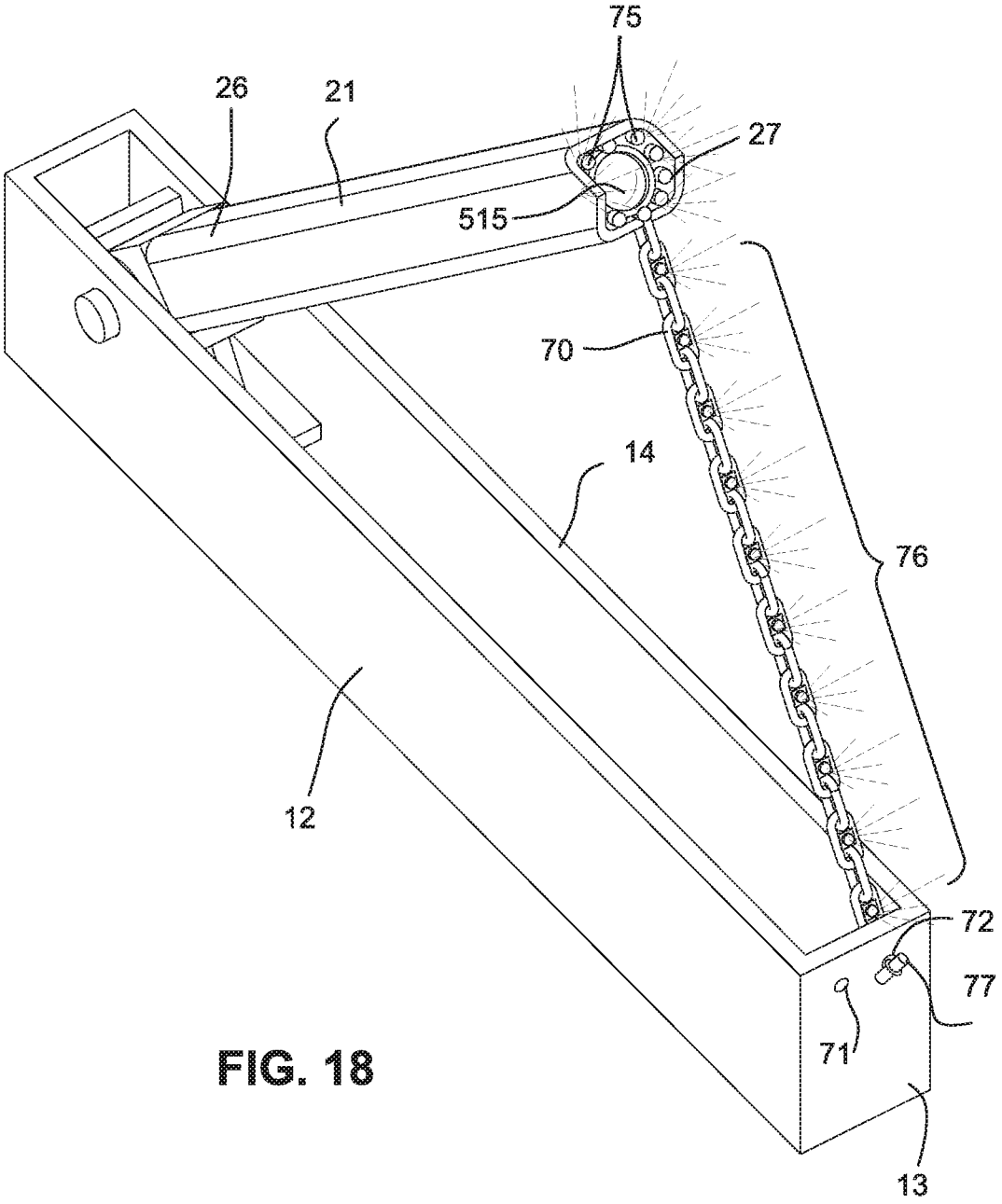
FIG. 18 shows a perspective view of a non-limiting, exemplary ground-based vehicle barrier system.

In an example, one chain 70 may be anchored to a front end 13 of the housing 10 and a distal end 27 of the bollard 20 by different mechanisms, such as by means of a pin, or a pair of mounting angles and a pin inserted there between. The chain 70 may be coupled to the front end 13 of the housing 10 and the distal end 27 of the sleeve 21 respectively via a pair of mounting brackets and a pin inserted there between or any other mechanisms. For example, FIG. 18 shows that the chain 70 is anchored to the front end 13 of the housing 10 through the hole 72 by means of a pin 77. As shown in FIG. 18, at least one chain 70 can be coupled to the front end 13 of the housing 10 by passing through a hole 71 and/or a hole 72 opened on the front end 13. In an example, the distance between the holes 71 and 72 may be about 2~3.5 inches, and the distance between the top of the housing and the central points of these two holes may about 1.5~2.5 inches. In other examples, the chain 70 can be coupled to the housing 10 and the sleeve 21 by any other means.

The chain 70 may limit the extension angle of the bollard 20, and prevent the bollard 20 from further extending. Without the chain, when a vehicle crashes into the bollard, due to the impact of the vehicle, the bollard 20 may further extend. The impact forces from the vehicle may be so strong that the barrier system can no longer restrict the further extension of the bollard, so that the vehicle may push the bollard and/or plate over to the ground and allowing the vehicle to break through. Therefore, the chain may be used to provide additional strength against impact forces applied by a vehicle.

In some examples, the chain 70 may connect to the housing 10 via a spring mechanism, so that the length of the chain is extensible as the vehicle, e.g., the bumper of the vehicle, hits the chain and continues to moving forward. As shown in FIG. 15, the chain 70 may, be stretched toward the proximal end of the sleeve 21 (e.g., to a position illustrated as 70') as the vehicle 110 further pushes the chain. In this way, the chain may be able to sustain stronger impact forces from the vehicle 110 and will also not be broken prematurely before the barrier system 600 actually captures the vehicle 110. Without the spring mechanism, the chain may be broken before the barrier system captures the vehicle, due to the strong impact forces from the vehicle 110 when the bumper of the vehicle suddenly hits it, and hence the vehicle may escape or further push the bollard over to the ground.

Figure 16:
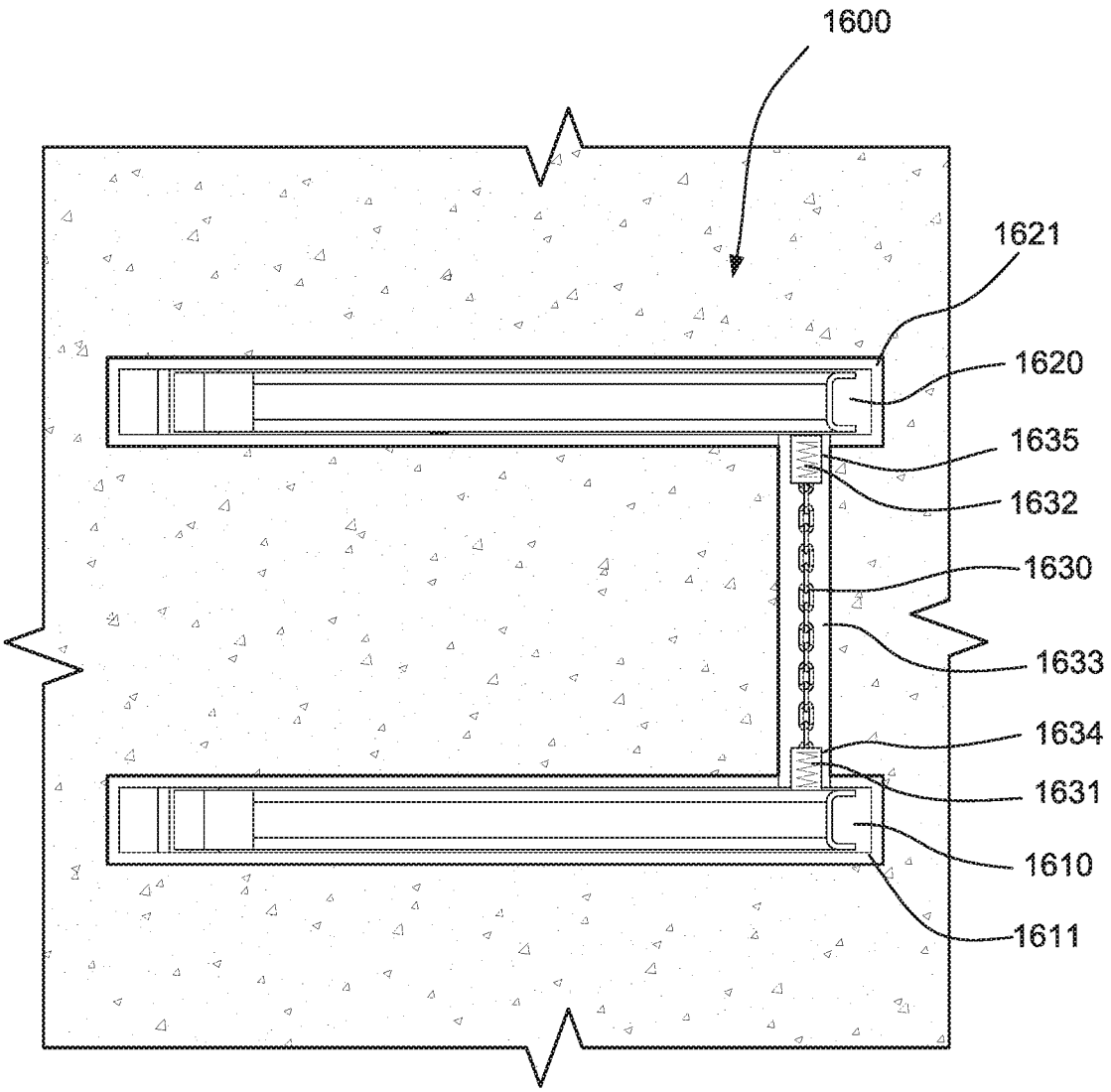
FIG. 16 shows a perspective view of a non-limiting, exemplary ground-based vehicle barrier system.
Figure 17:
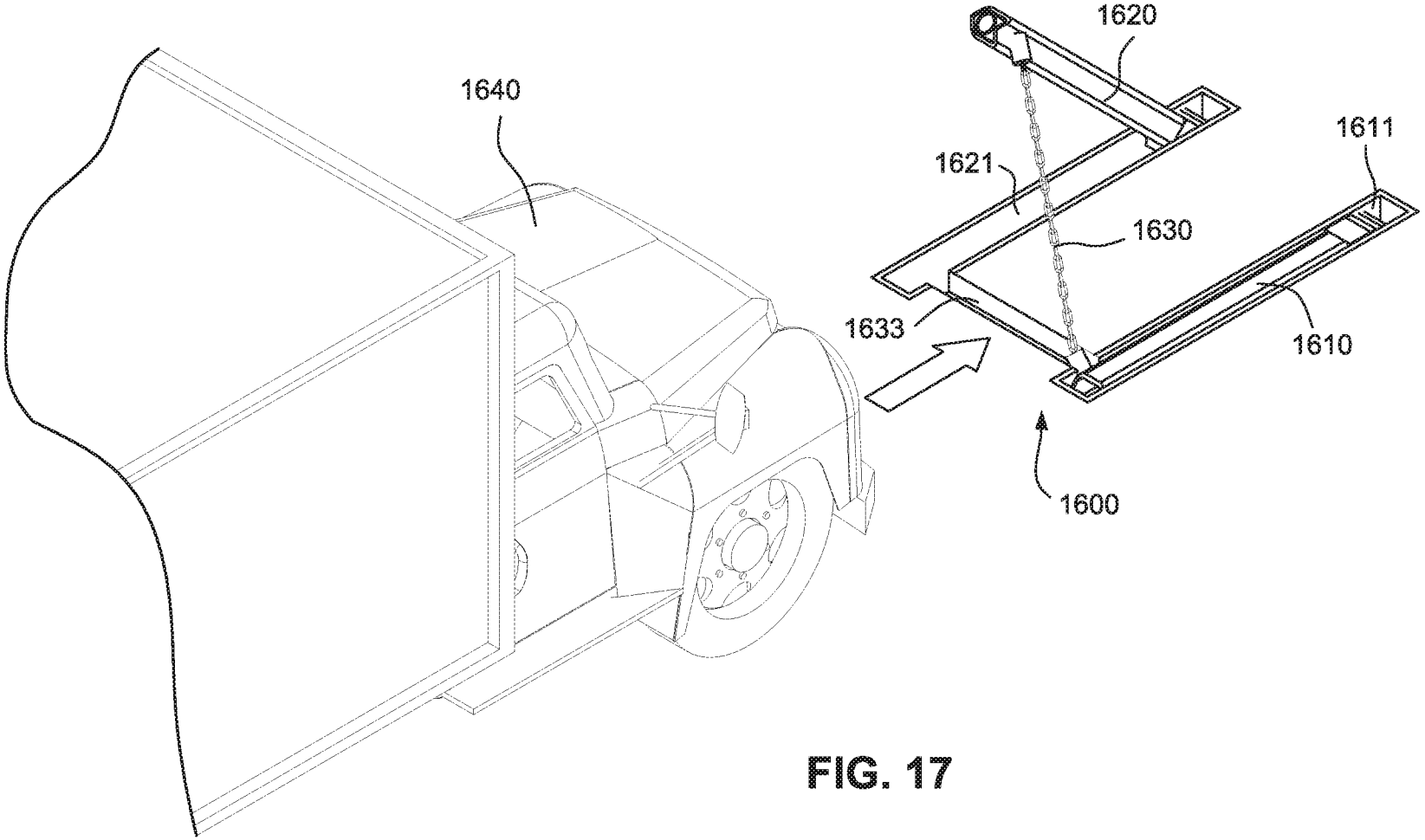
FIG. 17 shows a non-limiting, exemplary scenario for an exemplary ground-based vehicle barrier system.

In the above examples, one or more chains each may be constructed to connect a single one of the bollards of the barrier system to its corresponding housing. In another example embodiment, one or more chains each may also be constructed to connect two or more different bollards. As shown in FIGS. 16 and 17, a ground-based vehicle barrier system 1600 comprises a first bollard unit 1610 and a second bollard unit 1620 located within a first housing 1611 and a second housing 1621 respectively. Both the first and second housings 1611 and 1621 are embedded in the pavement. A groove 1633 in the pavement connects the first housing 1611 and the second housing 1621 on the distal end of the first and second bollard units 1610 and 1620. In this embodiment, an optional chain 1630 may connect with the distal ends of the first bollard unit 1610 and the second bollard unit 1620 via a first spring 1631 within a first spring cartridge 1634 and a second spring 1632 within a second spring cartridge 1635 respectively. The chain 1630 is placed within the groove 1633 while both the first and second bollard units are in their recessed positions.

In some examples, the first and second bollard units 1610 and 1620 may raise up or drop down simultaneously, although their movement may or may not be at the same speed. Alternatively, as shown in FIG. 17, one of the first and second bollard units 1610 and 1620 may raise up by itself while the other unit is still in its recessed position. The first and second springs 1631 and 1632 are constructed to allow adjusting the length of the connection between the first and second bollard units 1610 and 1620, so that the chain 1630 is allowed to play out enough to enable only one of the first and second bollard units 1610 and 1620 to raise up by itself, as shown in FIG. 17.

While the first bollard unit 1620 and/or the second bollard unit 1620 are raised up, the chain 1630 will raise up at least at one end to prevent a vehicle 1640 (e.g., a car, a bicycle or a motorcycle) to pass through. Without the raised chain, a space between the raised sleeves of the first and second bollard units may be large enough to allow a bicycle or a motorcycle to pass through. Moreover, the chain between the first and second bollard units may also help preventing the raised bollard(s) from being broken as the bollard collides with the vehicle. For example, when only one of the first and second bollard units is raised, the chain 1630 at one end is attached to the other bollard unit fixed in the pavement, so that it would be harder for the vehicle to further push forward the raised bollard unit and then break the bollard unit.

5) Example Controller, Sensors and Lights

The embodiment illustrated by the block diagram of FIG. 5 further comprises a controller 503 operatively connected to the drive 30 to control the drive 30 to pivot the bollard 20 between the recessed and extended positions. The controller 503 may be housed in a stand-alone device located in the ground or within a guardhouse, or sentry station. Alternatively, the controller 503 may be disposed within the housing 10 of the ground-based vehicle barrier system 300. The controller 503 may or may not be directly connected to the drive 30 of the barrier system 300. In some examples, the controller 503 is connected to the bollard 20 through a secure pipe placed in a trench over the ground.

As detailed below, the controller 503 is operated in response to a control signal generated manually or automatically.

In certain examples, a remote controller 511 may initiate a control signal and transmit the control signal to the controller 503. For example, the remote controller 511 has a manual control in the form of a push switch to selectively open or close at least one bollard and/or the panel fixedly coupled to one or more bollards. The remote controller 511 is operated by an operator, such as a security guard or other authorized personnel. In example embodiments, the operator may issue different commands via on the remote controller 511, e.g., a command to request a bollard to gradually raise up from its recessed position to its extended position, or another command to make one or more bollards to suddenly pop up to be in their extended positions.

In another example, the controller 503 is automatically operated to control the drive 30 based on either information provided by a driver or information collected from a system associated with a vehicle, e.g., a radio frequency identification (RFID) system. For example, the driver may provide an input to a terminal by entering a code, inserting a validation ticket, scanning a barcode, scanning an RFID badge, and/or entering biometric information. The controller 503 then identifies or authenticates the driver or the vehicle, based on the input from the driver or the information collected from the vehicle, prior to permitting vehicle passage. In this example, the bollard 20 may be retained in its recessed position until a vehicle driver seeks to traverse the barrier system at high speed without presenting proper identification or authorization to proceed. Alternatively, the ground-based vehicle barrier system 300 may always be retained in its extended position until a vehicle approaches the barrier and the driver presents proper identification or authorization to proceed.

In yet another example, the controller 503 comprises a microprocessor control system communicating with other sensors 510 and/or controls to automatically control the drive 30 based on information received from the sensors 510 and/or controls. On the other hand, the controller 503 may also be used to control the operation of one or more of the sensors 510 (e.g., a camera) or lights, etc. In order to do so, the controller 503 may comprise one or more communication interfaces with connected antenna, a wireless LAN module, a radio-frequency (RF), Infrared or Bluetooth® transceiver, and/or other near field communication transceiver module. One or more of these communication components may collectively provide a communication mechanism by which controller 503 can communicate with the remote controller 511, and/or the sensors 510, such as receiving or transmitting a control signal from the remote controller 503 and/or one of the sensors 510.

As shown in FIG. 5, the ground-based vehicle barrier system 300 includes one or more sensors 510 in communication with the controller 503. The sensors 510 may include any number and type of different sensors to detect the presence of vehicles seeking passage, including a camera 515, a proximity sensor 512, a weight measuring sensor 513, and/or an acceleration sensor 514. The sensors 510 may operate by detecting a change in the surrounding capacitance or inductance caused by the presence of a vehicle, which is transmitted to the controller 503. Other types of sensors can be used, such as a liquid level sensor, a distance sensor, a pressure sensor, an ultrasound sensor, and/or an infrared sensor. In these examples, the ground-based vehicle barrier system 300 may be recessed by default, but will be extended when the sensors 510 detect the presence of vehicles seeking passage. Further, the sensors 510 may also be used in conjunction with the controller 503 as a safety mechanism, so that the bollard 20 is not raised when a vehicle is located over the barrier, as inappropriate raising of the bollard 20 may cause unintended damages to the vehicle.

The sensors 510 may be installed at any locations in front of the ground-based vehicle barrier system 300, for example, being installed within a guardhouse or sentry station, buried into the ground, or installed within a housing of the barrier system 300. For example, a camera may be installed at a sentry station in front of the barrier system 300 to detect the presence of a vehicle based on captured images. In other examples, as shown in FIGS. 1-4, the sensors 510 may be buried into the ground in front of the ground-based vehicle barrier system 300 for detecting the presence of a vehicle and may be directly connected to the controller 503 or wirelessly communicates with the controller 503.

Figure 19:
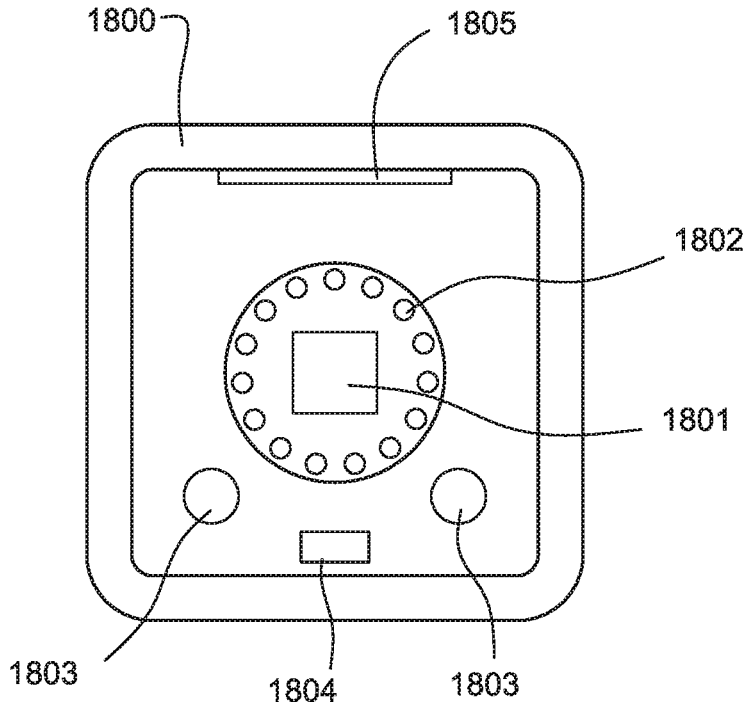
FIG. 19 shows a non-limiting, exemplary distal end of an example bollard.

In other examples, as shown in FIGS. 18-19, a camera or LED lights may be installed at the distal end 27 of the bollard 20. For example, FIGS. 18-19 show that the ground-based vehicle barrier system may employ physical indicators, such as LED lights, reflective tape, markers, or bright colors, to help increase visibility. In FIG. 18, one or more LED light 75 is attached to the distal end 27 of the bollard 20. Alternatively, a series or string of LED lights 76 may be attached to the chain 70 of the ground-based vehicle barrier system 600. These indicators can effectively capture drivers' attention to better assist them in visually identifying vehicle barriers from a distance, especially at night. Similarly, in FIG. 19, one or more LED lights 1802 are install at the distal end of an example bollard 1800.

In bollard 1800, a camera 1801 (e.g., a color camera) is also installed at the distal end of the bollard 1800, and is configured to capture one or more images or videos of a vehicle while the bollard 1800 is in its extended position or is raised. The pictures or videos captured by the camera 1801 may help an operator monitor and identify vehicles seeking passage of the bollard 1800. For example, the LED lights 1802 may be a LED ring light that fits around the camera

1801. The LED lights 1802 may provide uniform light coming straight from the camera's point of view, which helps eliminate shadows.

In addition, in FIG. 19, one or more distance sensor switches 1803 and/or at least one liquid level switch 1804 may also be installed at the distal end of the bollard 1800. The distance sensor switches 1803 and/or at least one liquid level switch 1804 are electronically connected with an Interface Circuit Board 1805. In some examples, each of the one or more distance sensor switches 1803 and/or at least one liquid level switch 1804 is configured to switch between "open" and "close" positions, so that it opens or closes a circuit of the Interface Circuit Board 1805.

In some examples, the Interface Circuit Board 1805 controls the operation of the camera 1801 and/or the LED lights 1802. In other examples, the circuit of the Interface Circuit Board 1805 may also control the movement of the bollard 1800 (e.g., between its recessed and extended positions). Therefore, the distance sensor switches 1803 may be used to control the operation of the camera 1801 and/or the LED lights 1802, and/or the movement of the bollard 1800.

Each of the distance sensor switches 1803 may comprise at least one distance sensor that senses the distance between an approaching vehicle and the bollard 1800. In particular, when there is no vehicle approaching the bollard 1800, the distance sensor switches will be in its "open" position to open the circuit in the Interface Circuit Board 1805, so that a drive (e.g., a cylinder) of the barrier system will not be controlled to cause the bollard to raise up, and the LED lights 1802 and the camera 1801 are turned off. In contrast, when the distance sensor of a distance sensor switch detects a vehicle being in proximity to the bollard 1800, the distance sensor switch will switch to its "close" position to close the circuit in the Interface Circuit Board 1805, so that the drive of the barrier system may be triggered to cause the bollard to raise up, and then the LED lights 1802 will emit light and/or the camera 1801 will be turned on to capture picture (s) or video of the vehicle.

In other examples, the bollard 1800 is preset to be in its extended position, and then the distance sensor switch may switch to its "close" position to turn on the LED lights 1802 and/or the camera 1801 whenever it detects that a vehicle is in proximity to it.

In an alternative example, the distance sensor switches 1803 may only be used to control the movement of the bollard, while the liquid level switch 1804 is used to turn on or off the camera 1801 and LED lights 1802.

The liquid level switch 1804 is configured to open or close the circuit of the Interface Circuit Board 1805 as the level of a free-flowing substance (e.g., a liquid) within a contained space rises or falls. As the level of the free-flowing substance may change as the bollard 1800 raises up, the liquid level switch 1804 may be configured to close the circuit as the bollard 1800 reaches a predetermined height, and to open the circuit as the bollard 1800 drops down. In this way, the liquid level switch 1804 is used to control the operation of the camera 1801 and/or LED lights 1802 in accordance with the position or movement of the bollard 1800.

6) Overview of the Components of an Example Barrier System

Figure 20:
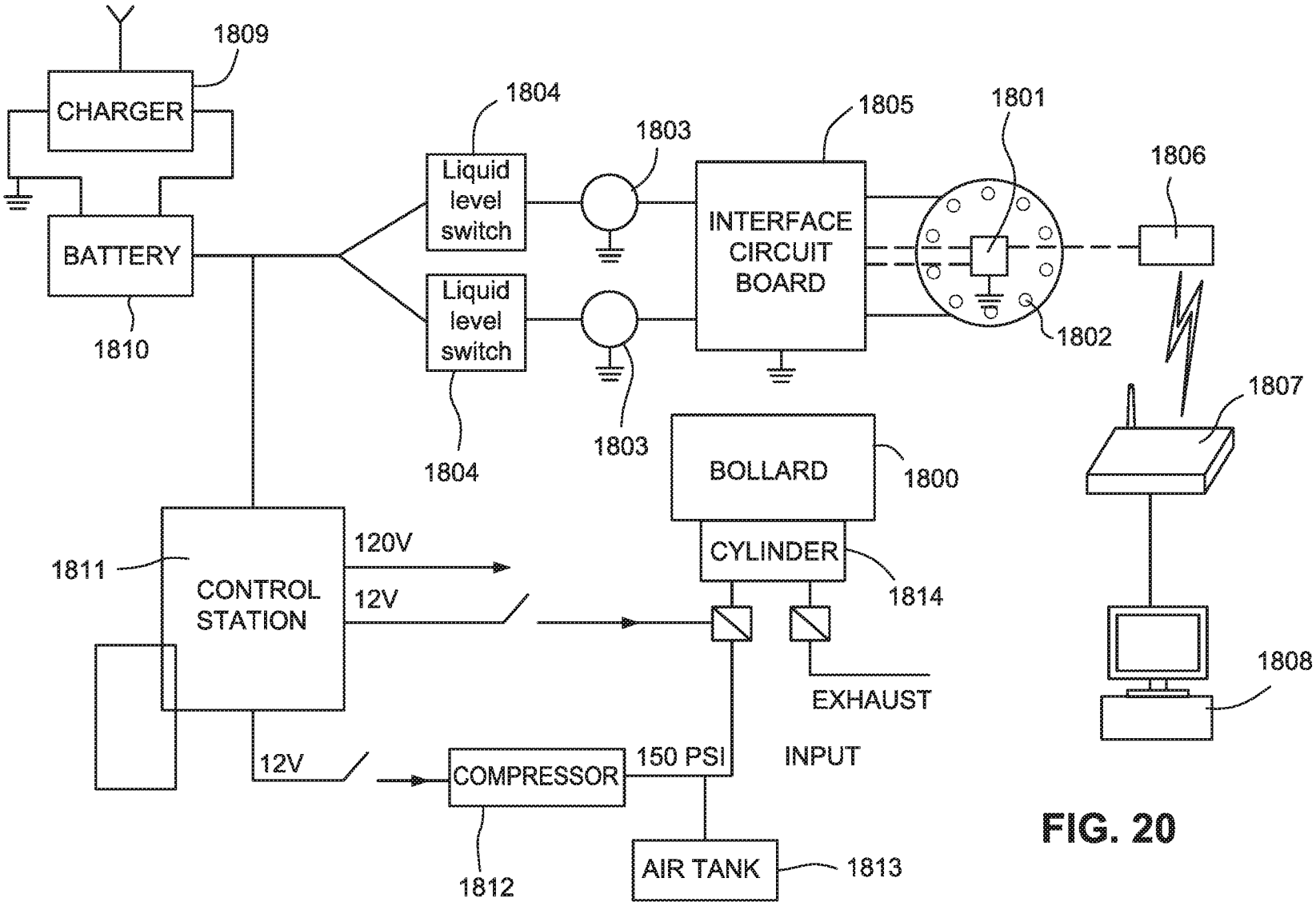
FIG. 20 shows a block diagram of an example ground-based vehicle barrier system.

FIG. 20 shows components of an example ground-based vehicle barrier system. The example ground-based vehicle barrier system comprises the bollard 1800, the liquid level switches 1804, the distance sensor switches 1803, and the Interface Circuit Board 1805, as disclosed above in connection with FIG. 19.

As discussed above, each of the liquid level switches 1804 and/or the distance sensor switches 1803 is electronically connected with the circuit provided in the Interface Circuit Board 1805 and is configured to switch between its open and close positions to open or close the circuit. In the meantime, the circuit of the Interface Circuit Board 1805 is also electronically connected with the LED lights 1802 and/or the camera 1801. As at least one of the liquid level switches 1804 and distance sensor switches 1803 switches between its open and close positions, the LED lights 1802 and/or the camera 1801 may be turned on or off accordingly.

In addition, the ground-based vehicle barrier system may further comprise a remote device 1808 configured to receive, store and review pictures/videos recorded by the camera 1801. The remote device 1808 may be a computer, a portable device, a mobile phone, or any other types of electronic device. The pictures and/or videos taken by the camera 1801 may be transmitted to the remote device 1808, via a transmitter 1806 coupled to the camera 1801. The pictures and/or videos transmitted from the camera 1801 are received by the remote device 1808 via a receiver 1807. Therefore, a user of the remote device 1808 may monitor vehicles attempting to pass through the barrier system based on the pictures and videos recorded by the camera 1801. In some embodiments, the transmitter 1806 and the receiver 1807 each may comprise one or more communication interfaces supporting radio communications (e.g., Wi-Fi communications), wireless LAN communication, cellular communications, near field communications, satellite communications, and/or the like.

The ground-based vehicle barrier system further comprises a control station 1811, which operatively connected to any type of drive, such as a cylinder 1814 shown in FIG. 20. The control station 1811 controls the drive to pivot the bollard 1800 between the recessed and extended positions automatically or in response to a command manually issued by an operator. In some embodiments, the cylinder 1814 may be a hydraulic cylinder, which gets its power from pressurized hydraulic fluid, such as compressed air, oil or other explosive type charge. In an example, air from an air tank 1813 may be compressed by a compressor 1812, and then the pressurized hydraulic air is received via a pipe or tube of the cylinder 1814 to drive a piston of the cylinder 1814 to move back and forth. As discussed above, in accordance with control signals issued from the control station 1811, the piston of the cylinder 1814 moves back and forth, and the back and forth movement of the piston causes the movement of the bollard 1800 between its recessed and extended positions.

In certain examples, the ground-based vehicle barrier system further comprises a charger 1809 and/or a battery 1810, which supply power to the barrier system. In an example, the charger 1809 is electronically connected to the battery 1810 and may charge the battery 1810 periodically or when it is requested or necessary. For example, the charger 1809 may be a solar charger that employs solar energy to supply electricity to the barrier system and/or charge battery 1810. Example voltage levels of the power supplied by the charger 1809 and/or battery 1810 to the barrier system may be 12 v or 120 v, or others.

Each of the example ground-based vehicle barrier systems disclosed above has a simple structure, and hence it is easy to manufacture, install, adjust, maintain or repair it. These barrier systems can easily fit into a box receptacle and can be extracted from the receptacle in a manner of minutes, since it is light weight, e.g., less than 850 pounds. As a result, these ground-based vehicle barrier systems can be conveniently shipped and installed into a gateway of a controlled area. On the other hand, these barrier systems are constructed to be robust enough to resist strong impact forces applied to it by a vehicle. Moreover, these barrier systems are ground-based and hence they decrease the risk of damaging authorized vehicles. Further, these ground-based barrier systems conveniently and effectively control and regulate traffic by moving their bollards between the recessed and extended positions automatically and/or manually. They therefore also provide improved performance and reliability during use.

While the present technology has been described in connection with several examples, it is to be understood that the present technology is not to be limited to the disclosed examples, but on the contrary, is intended to cover various modifications and equivalent arrangements.

What is claimed is:

1. A ground-based vehicle barrier system, comprising:

a bollard pivotably movable about a pivot axis between a recessed position permitting vehicle passage and an extended position inhibiting vehicle passage, a link fixedly connected to or formed as part of the bollard, the link extending transverse to the bollard, a proximal end of the link connecting directly to the bollard, a distal end of the link having a connection point, the connection point and the pivot axis being spaced apart and substantially vertically aligned when the bollard is in the recessed position, and a drive directly connected to the distal end of the link via the connection point and configured to selectively move the bollard in the recessed and extended positions.

2. The ground-based vehicle barrier system according to claim 1, wherein the bollard further comprises:

a sleeve having a distal end and a proximal end, the sleeve being reduced in thickness at the distal end, and an elbow piece connecting the proximal end of the sleeve with the link of the bollard.

3. The ground-based vehicle barrier system according to claim 2, wherein at least a portion of the link is thinner than the major portion of the elbow piece.

4. The ground-based vehicle barrier system according to claim 2, further comprising a backup member beside the elbow piece of the bollard and configured to restrict rearward movement of the bollard.

5. The ground-based vehicle barrier system according to claim 2, further comprising a LED light located at the distal end of the sleeve, wherein the LED light is configured to emit light when the bollard is in the extended position.

6. The ground-based vehicle barrier system according to claim 5, further comprising a camera located at the distal end of the sleeve, the camera being configured to record images and/or videos.

7. The ground-based vehicle barrier system according to claim 6, further comprising a liquid level switch installed on the sleeve, the liquid level switch being configured to control operation of the camera and/or the LED light.

8. The ground-based vehicle barrier system according to claim 6, further comprising a distance sensor switch, the distance sensor switch being configured to control operation of the camera and/or the LED light.

9. The ground-based vehicle barrier system according to claim 1, further comprising a housing including a front end and a back end and two sides forming an elongated space to accommodate the bollard while the bollard is in the recessed position.

10. The ground-based vehicle barrier system according to claim 9, wherein the housing further comprises a top lid covering at least a portion of the housing.

11. The ground-based vehicle barrier system according to claim 9, further comprising at least one anchor member connected to the front end and/or the back end of the housing, the at least one anchor member being configured to fix the housing into the ground.

12. The ground-based vehicle barrier system according to claim 9, further comprising a pivot shaft supported by the two sides of the housing, wherein the bollard is configured to rotate about the pivot shaft between the recessed and extended positions.

13. The ground-based vehicle barrier system according to claim 12, wherein the bollard further comprises a sleeve having a distal end and a proximal end and an elbow piece connecting the proximal end of the sleeve with the link of the bollard, and the elbow piece including a groove surrounding the pivot shaft.

14. The ground-based vehicle barrier system according to claim 1, further comprising a controller coupled to the drive, the controller being configured to control the drive to pivot the bollard between the recessed and extended positions in response to a control signal.

15. The ground-based vehicle barrier system according to claim 14, further comprising a remote controller to initiate the control signal.

16. The ground-based vehicle barrier system according to claim 14, further comprising a camera, a distance sensor, a proximity sensor, a weight measuring sensor and/or an acceleration sensor to initiate the control signal.

17. A ground-based vehicle barrier system, comprising:

a bollard pivotably movable about a pivot axis between a recessed position permitting vehicle passage and an extended position inhibiting vehicle passage, a link connected to or formed as part of the bollard, the link extending transverse to the bollard, the link having a connection point, the connection point and the pivot axis being substantially vertically aligned when the bollard is in the recessed position, a drive connected to the connection point and configured to selectively move the bollard in the recessed and extended positions, and a guide around the link to restrict lateral movement of the link, the guide being rectangular in cross-section and being open at one side.

18. The ground-based vehicle barrier system according to claim 1, wherein the drive is a hydraulic cylinder.

19. A ground-based vehicle barrier system, comprising:

a plurality of bollards disposed substantially parallel to each other, each of the bollards being pivotably movable about a pivot axis between a recessed position permitting vehicle passage and an extended position inhibiting vehicle passage, and each of the bollards comprising:

a link fixedly connected to or formed as part of the bollard, the link extending transverse to the bollard, a proximal end of the link connecting directly to the bollard, a distal end of the link having a connection point, the connection point and the pivot axis being spaced apart and substantially vertically aligned when the bollard is in the recessed position, and a drive directly connected to the distal end of the link via the connection point and configured to selectively move the bollard in the recessed and extended positions.

20. The ground-based vehicle barrier system according to claim 19, wherein each of the bollards further comprises:

a sleeve having a distal end and a proximal end, the sleeve being reduced in thickness at the distal end, and an elbow piece connecting the proximal end of the sleeve with the link of the bollard.

21. The ground-based vehicle barrier system according to claim 19, further comprising a housing including a front end and a back end and two sides forming an elongated space to accommodate at least one of the bollards while the bollard is in the recessed position.

22. The ground-based vehicle barrier system according to claim 19, further comprising a chain connected to at least two of the plurality of bollards.

23. A ground-based vehicle barrier system, comprising:

a panel, a bollard fixedly coupled to the panel, the panel and the bollard being pivotably movable together about a pivot axis between a recessed position permitting vehicle passage and an extended position inhibiting vehicle passage, a link fixedly connected to or formed as part of the bollard, the link extending transverse to the bollard, a proximal end of the link connecting directly to the bollard, a distal end of the link having a connection point, the connection point and the pivot axis being spaced apart and substantially vertically aligned when the bollard is in the recessed position, and a drive directly connected to the distal end of the link via the connection point and configured to selectively move the bollard in the recessed and extended positions.

24. The ground-based vehicle barrier system according to claim 23, wherein the bollard further comprises:

a sleeve having a distal end and a proximal end, the sleeve being reduced in thickness at the distal end, and an elbow piece connecting the proximal end of the sleeve with the link of the bollard.

25. A ground-based vehicle barrier system, comprising:

a bollard movable between a recessed position permitting vehicle passage and an extended position inhibiting vehicle passage, a backup member positioned at a proximate end of the bollard and configured to restrict rearward movement of the bollard when the bollard is in the extended position and subjected to a vehicular load, and a guide around the link to restrict lateral movement and to limit vertical movement beyond a predetermined limit upon application of a load on the bollard.

26. A ground-based vehicle barrier system, comprising:

a bollard movable between a recessed position permitting vehicle passage and an extended position inhibiting vehicle passage, a backup member positioned at a proximate end of the bollard and configured to restrict rearward movement of the bollard when the bollard is in the extended position and subjected to a vehicular load, another bollard being movable between a recessed position permitting vehicle passage and an extended position inhibiting vehicle passage, and a chain connecting distal ends of the bollard and the other bollard, ends of the chain each connecting to one of the bollards via a spring.

* * * * *